US006581500B1

(12) United States Patent
Kietaibl

(10) Patent No.: US 6,581,500 B1
(45) Date of Patent: Jun. 24, 2003

(54) PAPER TOWEL DISPENSING APPARATUS

(75) Inventor: Josef Kietaibl, Surrey (CA)

(73) Assignee: Englewood Ventures Inc., Surrey (CA)

( * ) Notice: Subject to any disclaimer, the term of this patent is extended or adjusted under 35 U.S.C. 154(b) by 0 days.

(21) Appl. No.: 09/176,652

(22) Filed: Oct. 21, 1998

Related U.S. Application Data

(60) Provisional application No. 60/064,828, filed on Oct. 21, 1997.

(51) Int. Cl.[7] ..... B26D 1/56; B23D 25/02

(52) U.S. Cl. ..... 83/337; 83/649; 83/334; 225/5; 225/39

(58) Field of Search ..... 83/334, 335, 337, 83/648, 649, 13, 298; 493/459; 312/34.1, 34.19; 225/5, 39

(56) References Cited

U.S. PATENT DOCUMENTS

| | | | | | |
|---|---|---|---|---|---|
| 1,811,537 | A | | 6/1931 | Cummings | |
| 2,051,242 | A | | 8/1936 | Birr et al. | 164/68 |
| 2,512,900 | A | | 6/1950 | Kwitek | 242/56 |
| 2,769,600 | A | | 11/1956 | Kwitek et al. | 242/56 |
| 2,916,956 | A | | 12/1959 | Salomon | 83/163 |
| 3,575,328 | A | * | 4/1971 | Jespersen | 225/2 |
| 3,641,857 | A | | 2/1972 | Vande Castle | 83/322 |
| 3,896,691 | A | | 7/1975 | Granger et al. | 83/335 |
| 4,142,431 | A | * | 3/1979 | Jespersen | 83/335 |
| 4,213,363 | A | * | 7/1980 | Granger | 83/298 |
| 4,621,755 | A | | 11/1986 | Granger | 225/96 |
| 4,635,837 | A | * | 1/1987 | Granger | 225/96 |
| 4,697,754 | A | | 10/1987 | Duff | 242/55 |
| 4,846,412 | A | | 7/1989 | Morand | 242/55 |
| 5,078,033 | A | * | 1/1992 | Formon | 83/335 |
| 5,416,960 | A | | 5/1995 | Kroyer | 28/165 |
| 5,836,862 | A | | 11/1998 | Granger | 493/459 |
| 2002/0073821 | A1 | * | 6/2002 | Broehl | 83/436.15 |
| 2002/0096028 | A1 | * | 7/2002 | Morand | 83/13 |

FOREIGN PATENT DOCUMENTS

| | | |
|---|---|---|
| GB | 613294 | 11/1948 |

* cited by examiner

*Primary Examiner*—Peter Vo
*Assistant Examiner*—Minh Trinh
(74) *Attorney, Agent, or Firm*—Michael R. Schacht

(57) ABSTRACT

A dispenser for sheet material such as paper towels. The paper towels are provided in a continuous roll. The roll is mounted within an enclosure above a drum. The drum contains a cutting assembly that moves between a retracted position and a cutting position. The cutting assembly cuts the sheet material when in the cutting position. The sheet material frictionally engages the drum such that pulling the sheet material out of the enclosure causes the drum to turn. The turning of the drum causes the cutting assembly to move between the retracted and cutting positions once every revolution of the drum. More specifically, a guide projection is formed on the cutting assembly, and a track assembly is formed on the enclosure. The guide projection engages the track assembly to cause the cutting assembly to move between the retracted and cutting positions.

11 Claims, 18 Drawing Sheets

PAPER TOWEL DISPENSING APPARATUS

This application claims priority of U.S. Provisional Patent Application Serial No. 60/063,828, which was filed on Oct. 21, 1997.

TECHNICAL FIELD

The present invention relates to paper towel dispensing apparatus and methods and, more specifically, to apparatus and methods that allow discrete paper towels to be dispensed in predetermined lengths from a continuous roll of paper towel material.

BACKGROUND OF THE INVENTION

Paper towels are often supplied in areas accessible to the general public. Dispensers for such paper towels are of two basic types. The first type contains a stack of discrete sheets of paper towels arranged such that, when the user pulls one sheet, the next sheet becomes available for the next user. The second type contains a continuous roll of paper towel material from which discrete sheets are cut or torn. The present invention relates to this second type of paper towel dispenser in which the paper towel material is provided in a continuous roll.

When paper towels are dispensed from a continuous roll, the dispenser will usually control or meter the dispensing process such that the user cannot dispense more than a predetermined amount of paper towel material in a given dispensing cycle. This metering feature prevents the user from dispensing the entire roll, wasting the paper towel material and leaving nothing for subsequent users.

One type of metered paper towel dispenser employs a lever that allows the roll to be rotated or advanced a predetermined amount. The advanced paper towel material extends out of the machine. When the user believes that a sufficient amount of paper towel material is exposed, the user grasps the exposed towel material and pulls against a cutting blade within the dispenser. The blade cuts off the exposed portion, leaving a paper towel in the user's hands for use. Lever-type paper towel dispensers create the possibility of cross-contamination between users because each user must grasp the same point (the lever handle) on the machine to advance the paper towel material.

Another type of metered paper towel dispenser employs an automatic cutting device. At least a small amount of paper towel material extends from the dispenser at all times. The user grasps the exposed towel material and pulls downward. The paper extends at least partly around a dispensing drum and turns the dispensing drum when the user pulls the material. The cutting device cuts the towel material at a certain point during the revolution of the dispensing drum such that a paper towel of a predetermined length is left in the user's hand and a small amount of paper towel material is exposed for the next user.

Metered paper towel dispenser with automatic cutting devices are relatively complex but greatly reduce the possibility of cross-contamination between users. Each user need only grasp the paper towel material to be dispensed, and not touch the dispenser, to obtain a paper towel. The present invention relates to such paper towel dispensers with automatic cutting devices.

The automatic cutting devices employed by paper towel dispensers can be relatively expensive to manufacture. In addition, the complexity of these cutting devices raises the possibilities of mechanical failure and jamming of the towel material within the dispenser. The need thus exists for inexpensive and reliable metered paper towel dispenser with an automatic cutting device.

OBJECTS OF THE INVENTION

From the foregoing, it should be apparent that a primary object of the present invention is to provide improved paper towel dispensing apparatus and methods.

Another more specific object of the present invention is to provide a paper towel dispenser having a favorable mix of the following characteristics:

Reduces the possibility of cross-contamination between users;

Dispenses paper towels in predetermined lengths from a continuous roll of paper towel material;

Minimizes the likelihood that the paper towel material will become jammed within the machine; and Can be manufactured at reasonable cost.

SUMMARY OF THE INVENTION

The present invention is a sheet material dispensing system that dispenses portions of sheet material from a roll of sheet material. The roll is mounted within an enclosure above a drum. The drum contains a cutting assembly that moves between retracted and cutting positions relative to the drum. An actuator assembly causes the cutting assembly to move between the retracted and cutting positions as the drum rotates. Sheet material on the roll is pulled from the dispensing system and frictionally engages the drum to rotate the drum about a drum axis. The actuator assembly causes the cutting assembly to cut the sheet material once each revolution of the drum such that the sheet material is dispensed in portions of a predetermined size. In the preferred system, the sheet material is a paper towel material and the dispensed portions are used as paper towels.

The system of the present invention inhibits cross-contamination between users by eliminating the need for users to touch the same object during normal use. The present system is reliable, relatively easy to fabricate and service, and does not allow the entire roll to be dispensed in one long sheet.

DETAILED DESCRIPTION OF THE INVENTION

Figure 1:
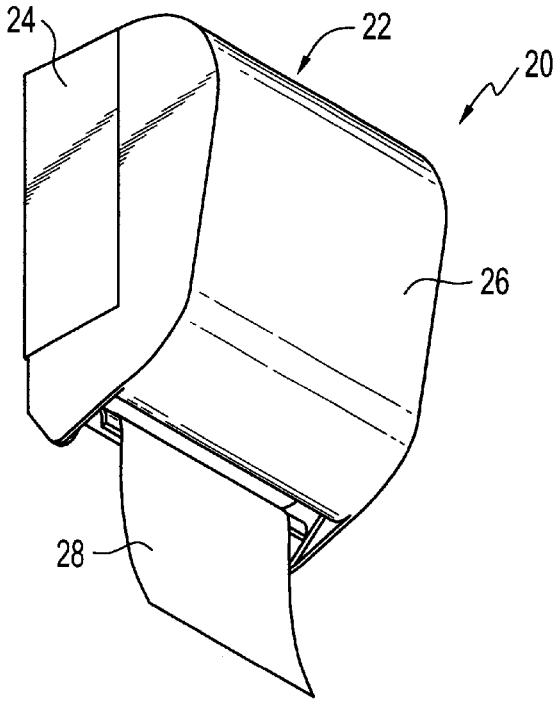
FIG. 1 is a perspective view of a towel dispensing assembly constructed in accordance with, and embodying, the principles of the present invention.

Referring initially to FIG. 1, depicted at 20 therein is a towel dispenser system for sheet material 28 constructed in accordance with, and embodying, the principles of the present invention. This system 20 is intended to be mounted on a wall and comprises an enclosure assembly 22 comprising a mounting assembly 24 and a cover member 26. The enclosure assembly 22 defines an enclosure chamber 27.

Figure 2:
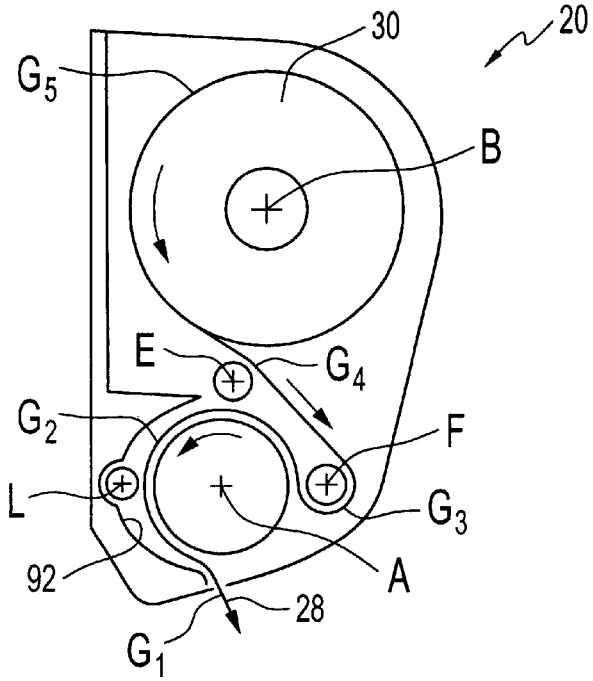
FIG. 2 is a schematic side view of the dispensing system 20 showing a dispensing path of sheet material therefrom.

As shown in FIG. 2, the system 20 is intended to dispense sheet material 28 from a roll 30. In the exemplary dispenser system 20, the sheet material 28 is paper towel material appropriate for use as a paper towel. The dispenser system 20 dispenses the sheet material 28 in discrete sections of a predetermined length. The system 20 accomplishes this without requiring the user to touch anything other than the sheet material 28 itself.

Figure 4:
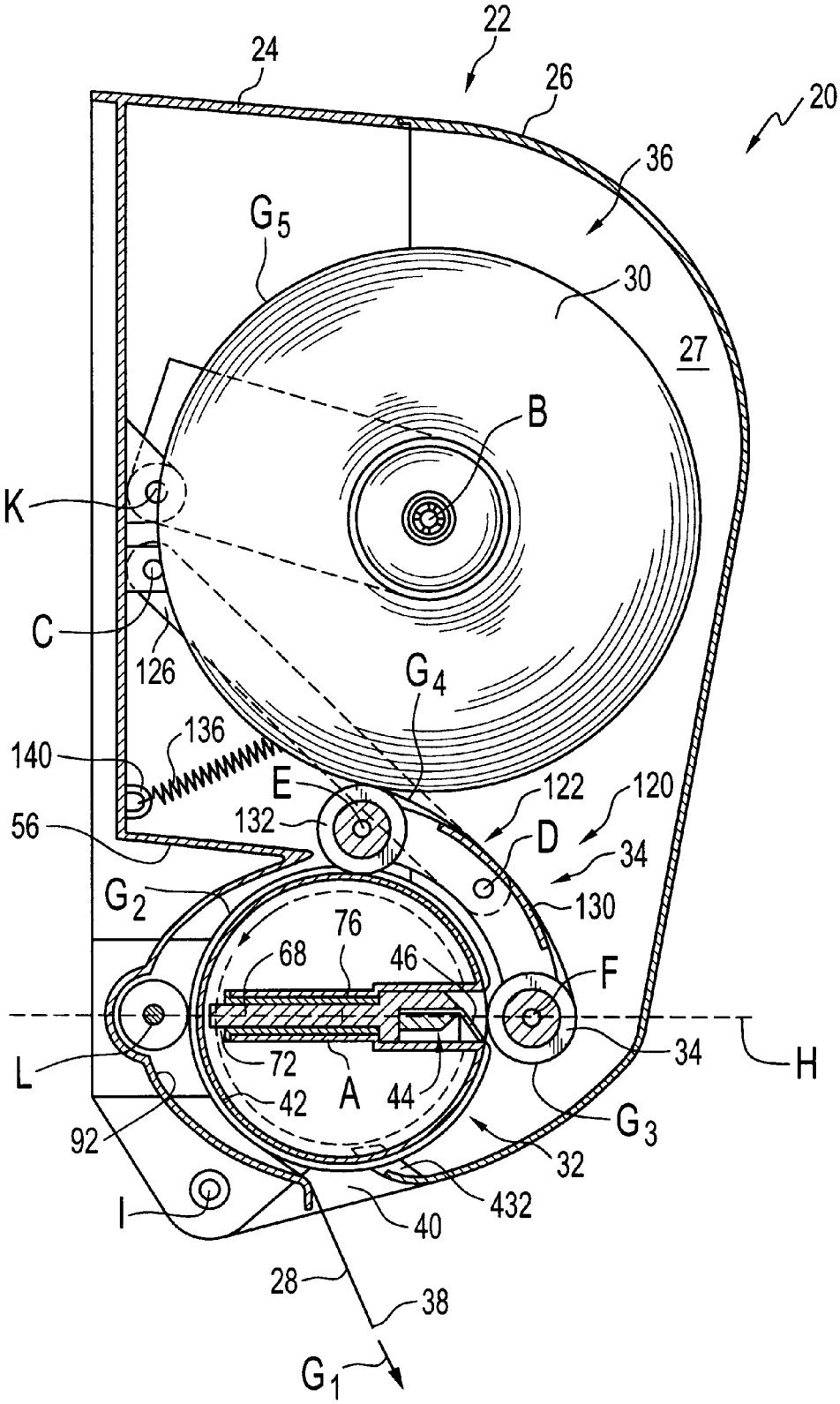
FIG. 4 is a side elevational cut-away view taken along lines 4—4 in FIG. 3.

Referring now for a moment to FIGS. 2 and 4, depicted therein are certain reference points that will be used during the following explanation of the construction and operation of the system 20. In particular, the system 20 defines a drum axis A, a roll axis B, first and second tension arm axes C and D, first and second tension roller axes E and F, a dispensing path G ($G_1$–$G_5$), a cutting plane H, a cover hinge axis I, roll hinge axis J (FIG. 22), a roll pivot axis K, and a wheel roller axis L.

Figure 3:
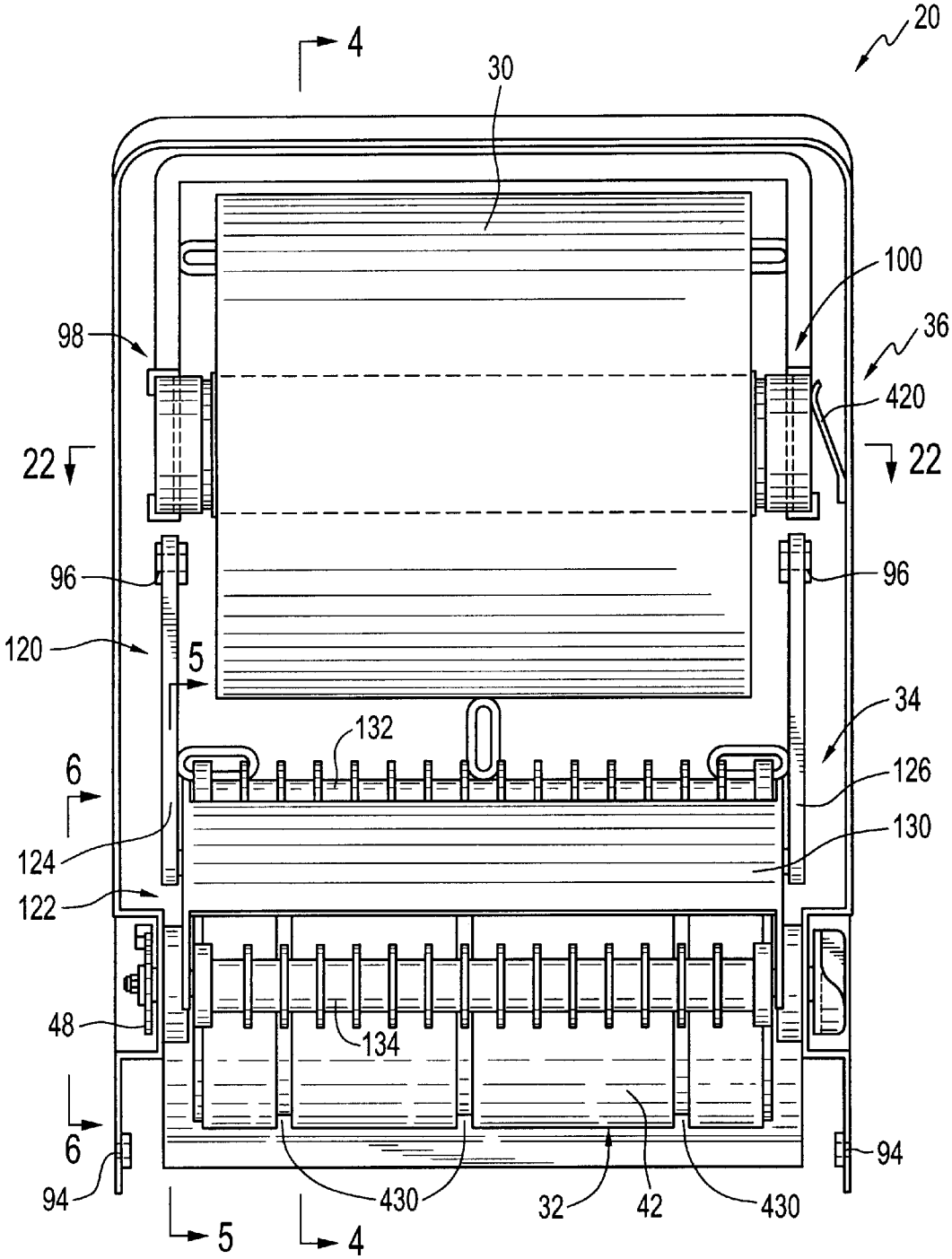
FIG. 3 is a front elevational view of the dispensing assembly of FIG. 1 with its cover removed, a roll of sheet material loaded therein but the sheet material is not fed along the dispensing path for purposes of clarity.

Referring now to FIGS. 3 and 4, the basic construction and operation of the dispensing system 20 will now be described. This system 20 basically comprises a drum assembly 32, a tension assembly 34, and a roll mounting assembly 36.

The roll mounting assembly 36 mounts the roll 30 above the tension assembly 34 and the drum assembly 32. The sheet material 28 is fed under the roll 30, over a portion of the tension assembly 34 and back up between the tension assembly 34 and the drum assembly 32, with the tension assembly 34 holding the sheet material against the drum assembly 32. As shown in FIG. 4, a cut end 38 of the sheet material 28 extends out of the enclosure chamber 27 through an elongate opening 40.

As perhaps best shown in FIG. 4, the drum assembly 32 comprises a generally cylindrical drum member 42 and a cutting assembly 44. The drum member 42 is mounted to the mounting assembly 24 such that the drum member 42 axially rotates about the drum axis A. The cutting plane H is defined by the cutting assembly 44. The cutting assembly 44 is mounted within the drum member 42 such that the cutting plane H extends through the drum axis A. And since the cutting assembly 44 is mounted within the drum member 42, rotation of this drum member 42 causes the cutting plane H to rotate about the drum axis A.

Figure 13:
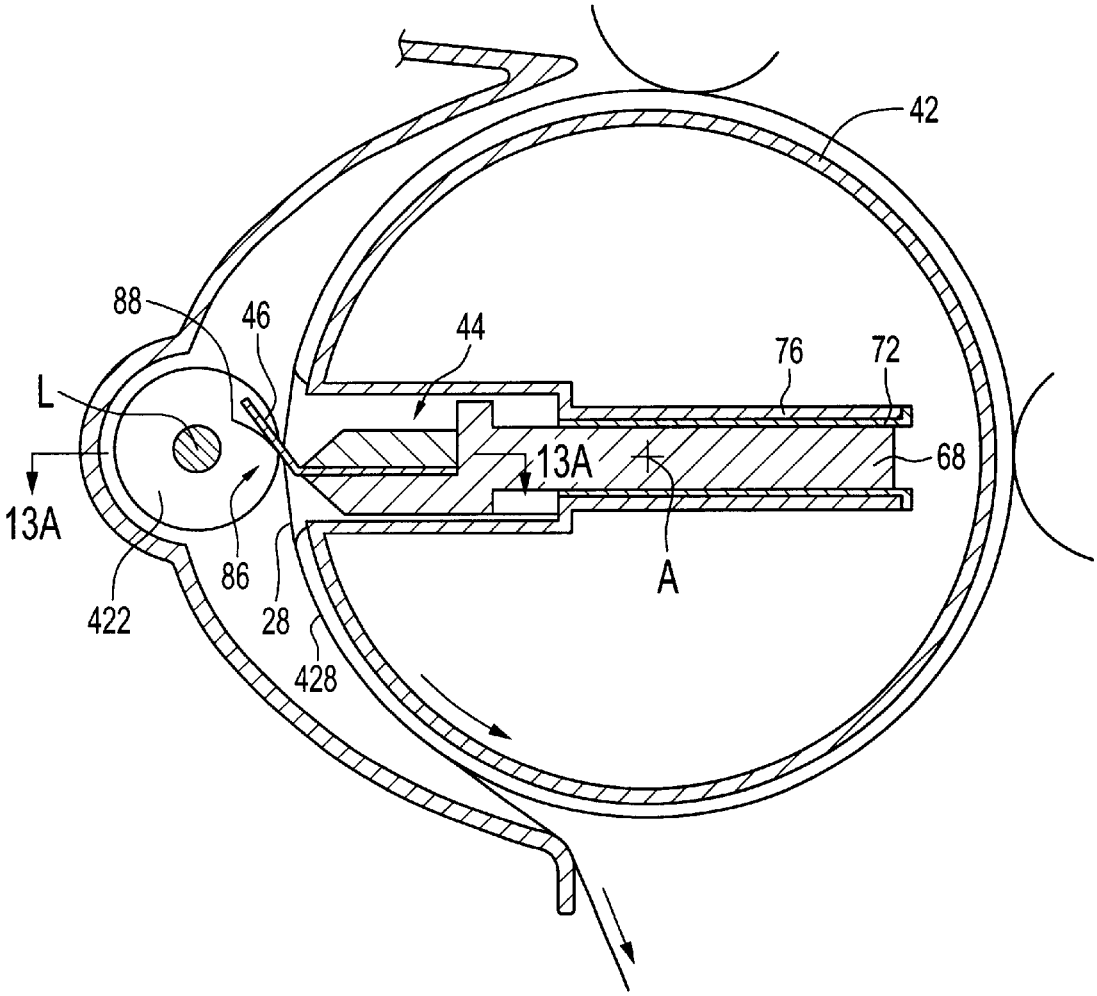
FIG. 13 is a partial cut-away view from the same perspective as FIGS. 8 and 10.

Additionally, the cutting assembly 44 is mounted to the drum member 42 such that at least a portion of the cutting assembly 44 can move along the cutting plane H between a retracted position such as that shown in FIG. 4 and a cutting position such as that shown in FIG. 13.

In the cutting position, a cutting blade 46 forming a part of the cutting assembly 44 extends out of the drum member 42 and perforates the sheet material 28. In the retracted position, the cutting assembly 44 is withdrawn into the drum member 42 such that the blade 46 does not come into contact with the sheet material 28.

To keep the construction and operation of the dispensing system 20 simply, the only external power supplied thereto is from the user pulling downward on the cut end 38 of the sheet material 28. No other external power sources such as electrical motors are used by the system 20.

To the contrary, simply grasping the cut end 38 of the sheet material 28 and then pulling the sheet material along its dispensing path G provides all of the power necessary to perform the functions described below. To explain this, it should be noted that the dispensing path G may be divided into a series of portions $G_1$, $G_2$, $G_3$, $G_4$, and $G_5$. The dispensing path portion $G_1$identifies the direction in which the sheet material is pulled out of the elongate opening 40. This path portion $G_1$ is generally linear, and the exact angle at which this path portion $G_1$ extends relative vertical and horizontal is not critical.

The dispensing path portion $G_2$ extends along the outside of the drum member 42 and is thus basically circular. In particular, this path portion $G_2$ is an arcuate path that extends for slightly less than approximately 270°.

The path portion $G_3$ extends over a cylindrical portion of the tension assembly 34 and thus is also arcuate. This path portion $G_3$ extends around approximately 180°.

The path portion $G_4$ is straight and extends between the roll 30 and the tension assembly 34.

And, finally, the path portion $G_5$ is essentially circular, generally corresponding to the outer surface of the roll 30 of sheet material 28.

When a downward force is applied to the cut end 38 of the sheet material 28 along the path portion $G_1$, the sheet material 28 is held against the drum member 42 along the dispensing path portion $G_2$ by the downward force on the cut end 38 and the tension assembly 34. Friction is developed between the sheet material 28 and the drum member 42 along this path portion $G_2$ such that downward motion of the sheet material 28 along the path portion $G_1$ results in axial rotation of the drum member 42 about the drum axis A. This rotation supplies the power necessary to operate the system 20.

The cutting assembly 44 engages the mounting assembly 24 such that rotation of the drum member 42 about the drum axis A results in a reciprocal movement of the cutting assembly 44 along the cutting plane H.

Figure 16:
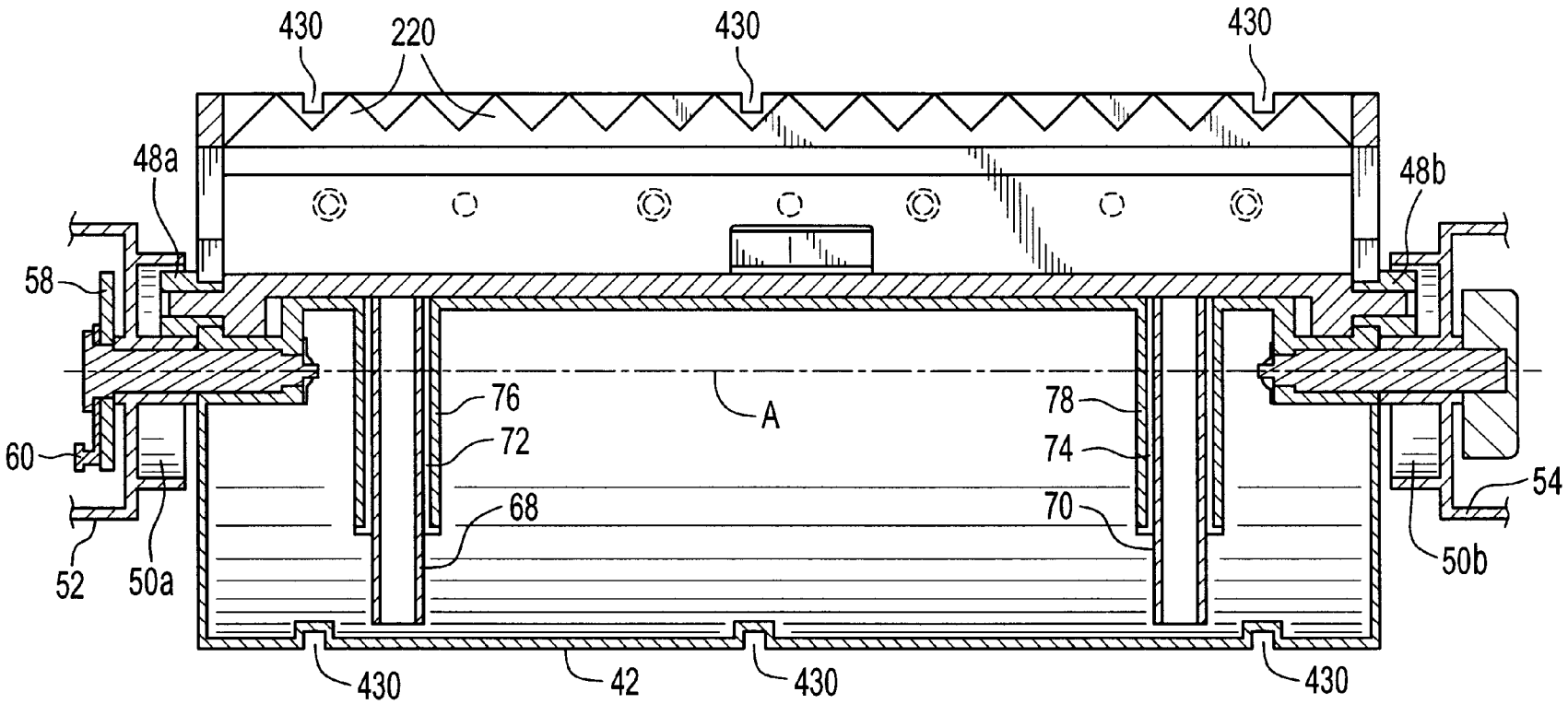
FIG. 16 is a partial cut-away view of the drum assembly of the present invention.

In particular, as is perhaps best shown in FIG. 16, the cutting assembly 44 comprises first and second guide members 48*a* and 48*b* which reside in first and second tracks 50*a* and 50*b*, respectively. These tracks 50*a* and 50*b* are defined by track members 52 and 54 that form a part of the mounting assembly 24. The mounting assembly 24 comprises a base member 56 (FIG. 3) to which the track members 52 and 54 are rigidly connected.

The guide members 48*a* and 48*b* engage the track members 52 and 54 such that the guide members 48*a* and 48*b* follow a guide path defined by the tracks 50*a* and 50*b*. This guide path is a closed, generally ovoid path that maintains the cutting assembly 44 in its retracted position for approximately 270° of the rotation of the drum member 42 and causes the cutting assembly 44 to move from its retracted position (see FIG. 9) to its cutting position (see FIG. 13) and back to its retracted position in the remaining 90° of rotation of the drum member 42.

Referring back to FIG. 16, it can be seen that the drum assembly 32 further comprises a ratchet member 58 and a spring attachment member 60 that are rigidly connected to the drum member 42. As will be described in further detail below, the ratchet member 58 allows the drum member 42 to rotate only in the direction the sheet material 22 follows along the dispensing path portion $G_2$. And the spring attachment member 60 plays a part in rotating the drum member 42.

Referring now to FIGS. 5–15, depicted therein are the interactions between mounting assembly 24, drum assembly 32, and cutting assembly 44 that cause the sheet material 28 to be dispensed in discrete sheets of a predetermined length.

In particular, shown in FIGS. 5, 8, 11, and 14 are the interactions between the guide member 48 and ratchet member 58 that cause the cutting assembly to move between the retracted and cutting positions.

FIGS. 6, 9, 12, and 15 depict how the ratchet member 58 allows the drum member 42 to rotate only in one direction. The ratchet member 58 engages to catch member 62 in a manner that will become apparent from the following discussion.

Figure 6:
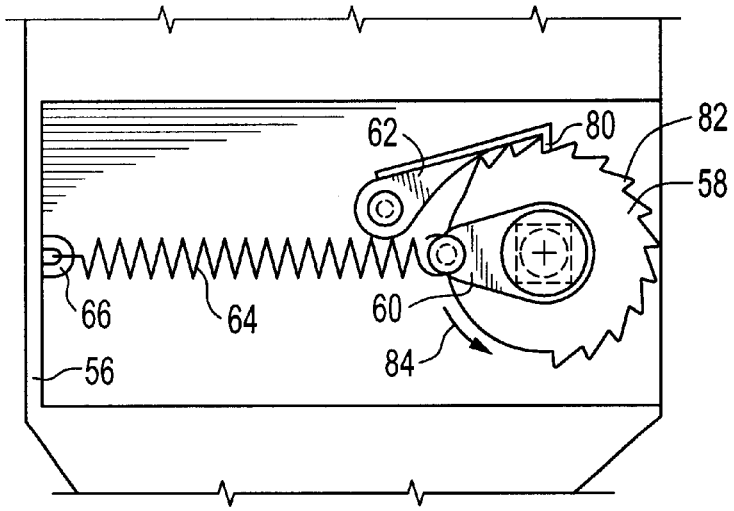
FIG. 6 is a side elevational view taken along lines 6—6 in FIG. 3.

FIG. 6 also shows a flywheel spring 64 that is connected between the spring attachment member 60 and a base attachment point 66 on the base member 56 to oppose rotation of the drum member 42 (not shown) throughout a first portion of its rotation and assist rotation of the drum member 42 about a second portion of its rotation.

Figure 18:
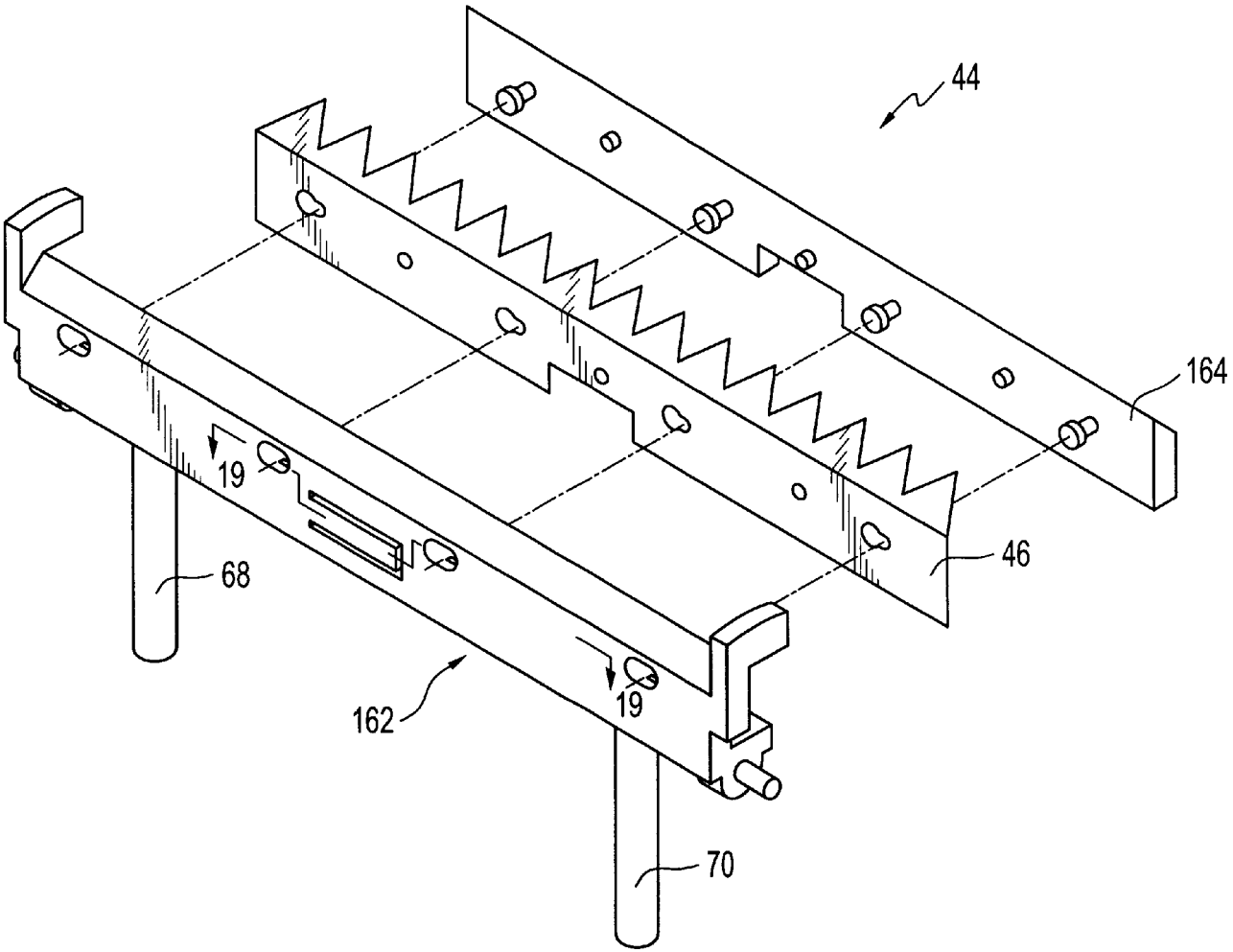
FIG. 18 is an exploded view of the cutting assembly.

FIGS. 7, 10, 13, and 16 depict interactions between the drum member 42 and the cutting assembly 44 that ensure that the cutting assembly 44 moves only along the cutting plane H relative to the drum member 42. The cutting assembly 44 comprises first and second guide pins 68 and 70 that reside within guide channels 72 and 74 defined by first and second guide portions 76 and 78 of the drum member 42. These pins 68 and 70, guide channels 72 and 74, and guide portions 76 and 78 are perhaps best shown in FIGS. 16 and 18.

FIGS. 7, 10, 13, and 16, depict the guide pin 68, guide channel 72, and guide portion 76; the guide pin 70, guide channel 74, and guide portion 76 operate in the same basic manner and will not be described in detail herein.

Figure 5:
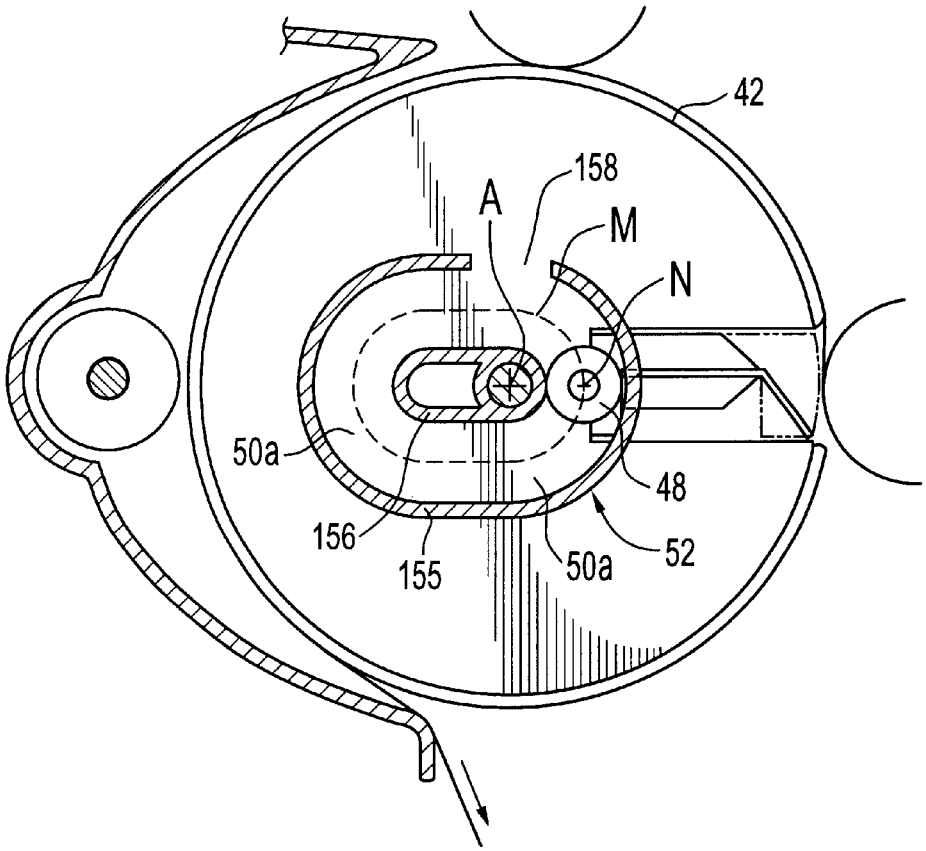
FIG. 5 is a partial cut-away view taken along lines 5—5 in FIG. 3.

FIGS. 4, 5, and 6 depict the status of certain portions of the dispensing system 20 when it is in what will be referred to as the rest state. In this rest state, the cutting assembly 44 is in its retracted position, with the blade 46 pointing generally forward (to the right in FIG. 4). When idle, the dispensing system 20 will be in the rest state shown by FIG. 4, 5, and 6.

Referring for a moment to FIG. 5, depicted therein at M is the guide path along which the guide member 48 travels as the drum member 42 rotates about its axis. In the rest state, a longitudinal axis N of the guide member 48 is a first distance from the drum axis. A. And as shown in FIG. 6, an engaging portion 80 of the catch member 62 engages on of a plurality of teeth 82 formed on the ratchet member 58. The catch member 62 thus engages the ratchet member 58 in a manner that allows rotation of the ratchet member 58 in the direction shown by arrow 84 in FIG. 6 but not in the direction opposite of that shown by the arrow 84. The flywheel spring 64 is at its shortest length when the system 20 is in its rest state.

Figure 7:
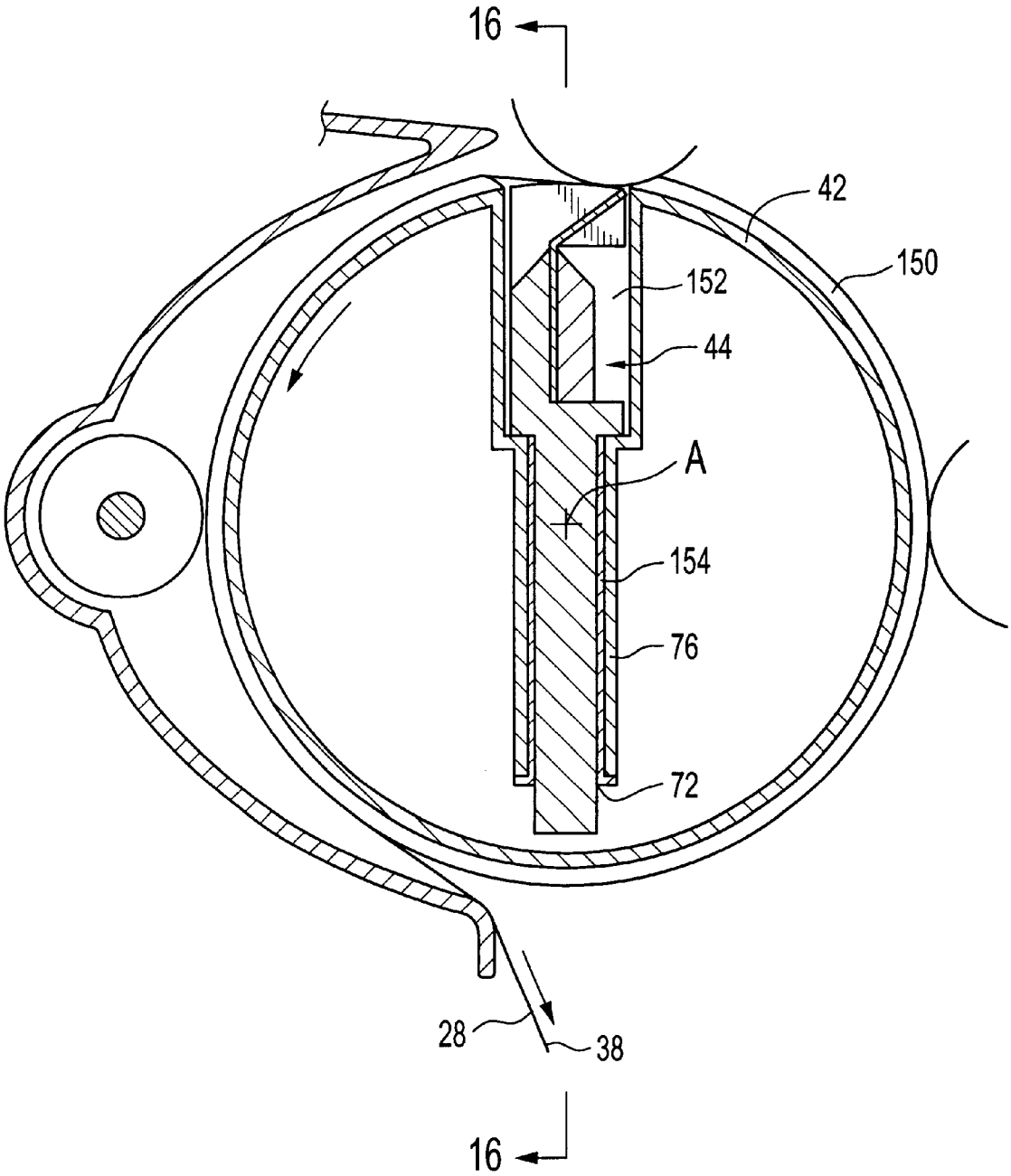
FIG. 7 is a partial cut-away view of a portion of the dispensing assembly from the perspective of lines 4—4 in FIG. 3.
Figure 8:
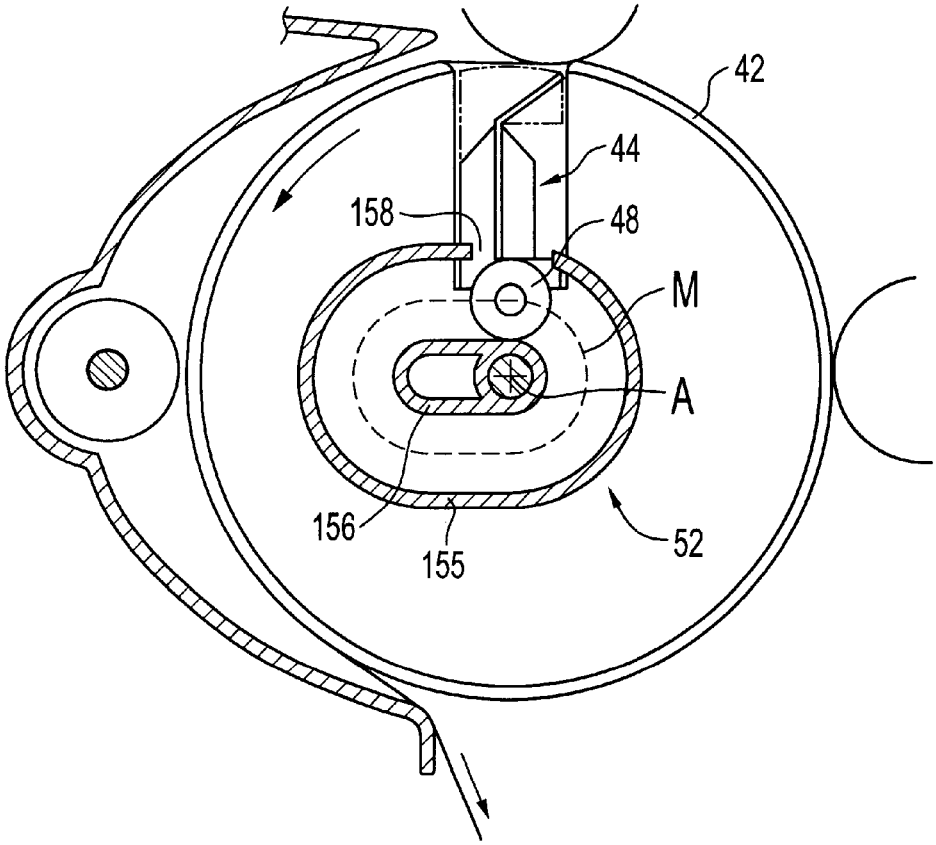
FIG. 8 is a partial cut-away view from the perspective of lines 5—5 in FIG. 3.
Figure 9:
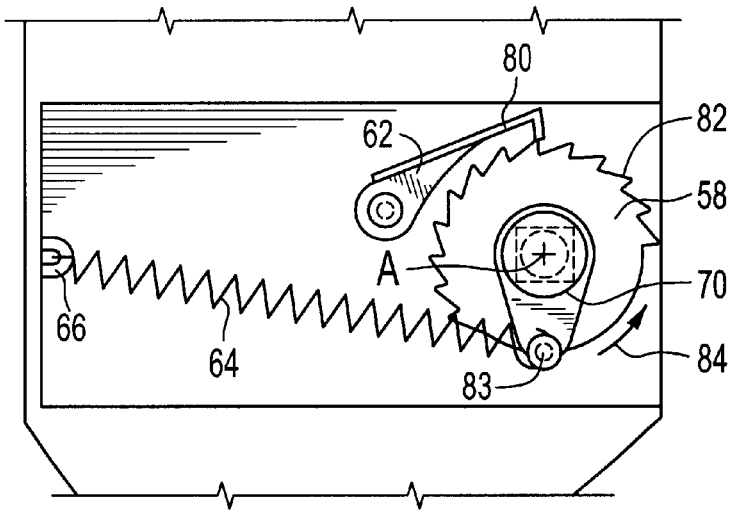
FIG. 9 is a side elevational view taken from the perspective of lines 6—6 in FIG. 3.

Referring now to FIGS. 7, 8, and 9, a user has grasped the cut end 38 of the sheet material 28 and pulled downward a short distance equal to approximately one-fourth of the circumference of the drum member 42. The state shown in FIGS. 7, 8 and 9 will be referred to as the "precut state".

In the precut state, as shown by a comparison of FIGS. 5 and 8, the guide member 48 has rotated partly along the guide path M. The distance between the longitudinal axis N and the drum axis A is still the same as that shown in FIG. 5, but the cutting assembly 44 has rotated such that the cutting plane H is now substantially vertical.

FIG. 9 shows that the catch member 62 moves over the teeth 82 of the ratchet member 58 such that, if the force applied to the sheet material 28 is removed, the drum member 42, and thus the cutting assembly 44, can rotate only a short distance back from the position shown in FIG. 8 toward the position shown in FIG. 5.

FIG. 9 also shows that the spring attachment member 60 is rigidly connected to the drum member 42 such that the rotation of the drum member 42 rotates an attachment point 83 on the spring attachment member 60 about the drum axis A. The flywheel spring 64 is connected to the attachment point 83, so the spring 64 begins to elongate and exert an opposing force against the rotation of the drum member 42 in the precut state.

Figure 10:
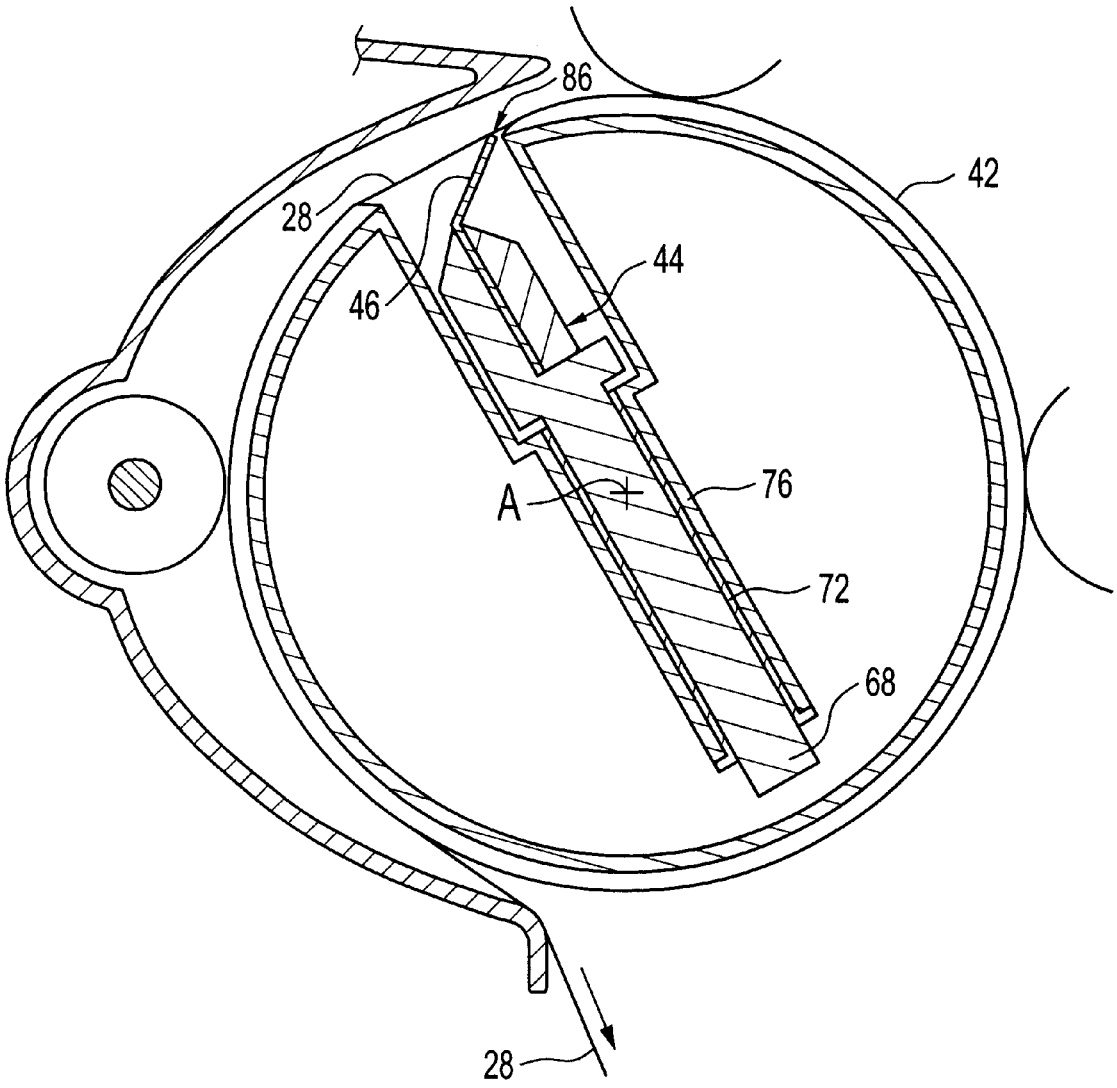
FIG. 10 is a partial cut-way view taken from a perspective similar to that of FIG. 7.
Figure 11:
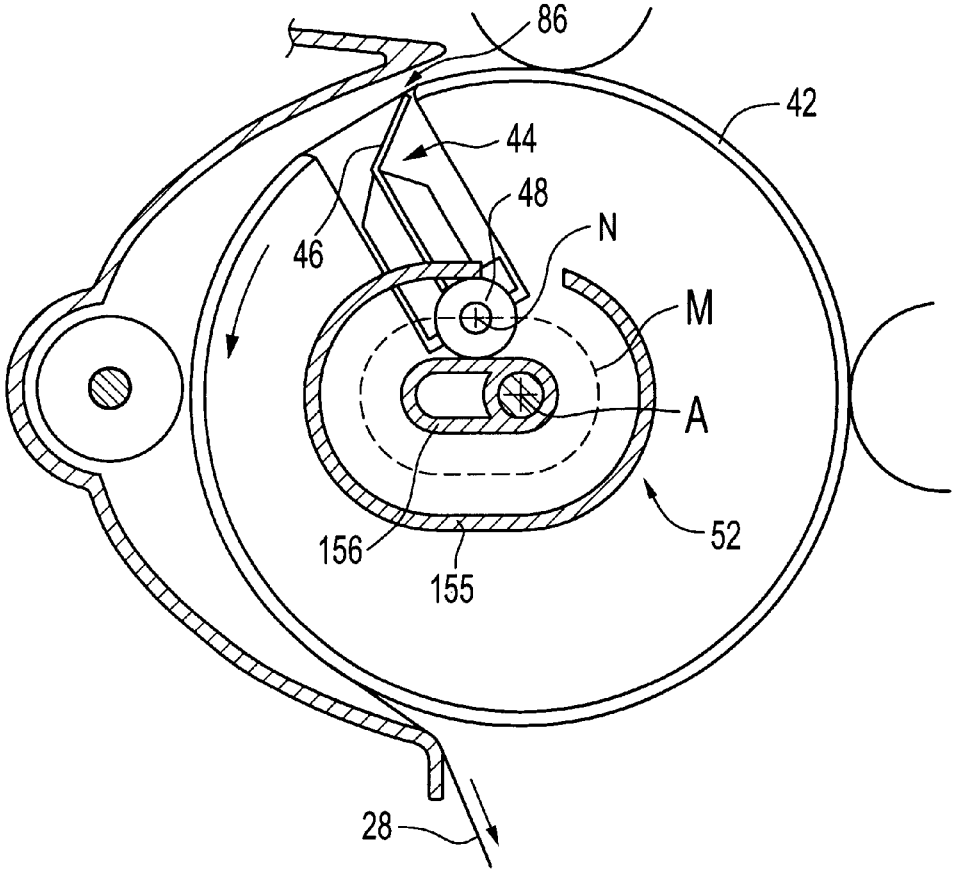
FIG. 11 is a partial cut-away taken from the same perspective as FIG. 8.
Figure 12:
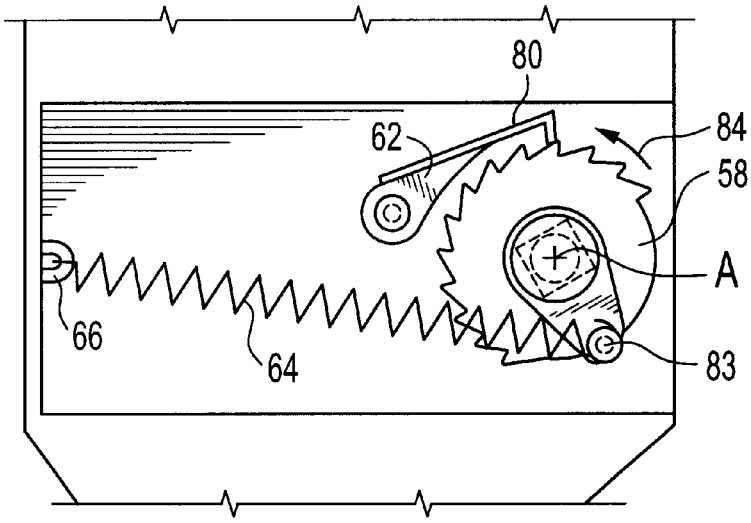
FIG. 12 is a side elevational view taken from the same perspective as FIG. 9.

Referring now to FIGS. 10, 11, and 12, the dispensing system 20 is depicted therein entering its "cutting state". In its cutting state, the cutting blade 46 engages and perforates the sheet material 28 at a location 86.

A comparison of FIGS. 7 and 10 illustrates that the cutting assembly 44 has not only rotated about the drum axis A but has moved along the cutting plane H toward the cutting location 86.

The reason for this radial motion of the cutting assembly 44 along the cutting plane H is shown in FIG. 11. FIG. 11 illustrates that the guide member axis N is now farther from the drum axis A than it was in either the rest state of the precut state. From the point shown in FIG. 11, the track member 52 engages the guide member 48*a* (and although not shown, track member 54 engages the guide member 48*b*) to force the cutting assembly 44 out of the drum member 42 and against the sheet material 28 at the cutting location 86. As briefly mentioned above, the downward force applied on the cut end 38 of the sheet material 28 as well as the pressure applied by the tension assembly 34 causes the blade 46 to pierce the sheet material 28 at the cutting location 86.

FIG. 12 illustrates that the ratchet member 58 engages the catch member 62 as generally described above to prevent backwards rotation of the drum member 42. FIG. 12 also shows that the flywheel spring 64 is further elongated as compared to the rest and precut states.

Figure 14:
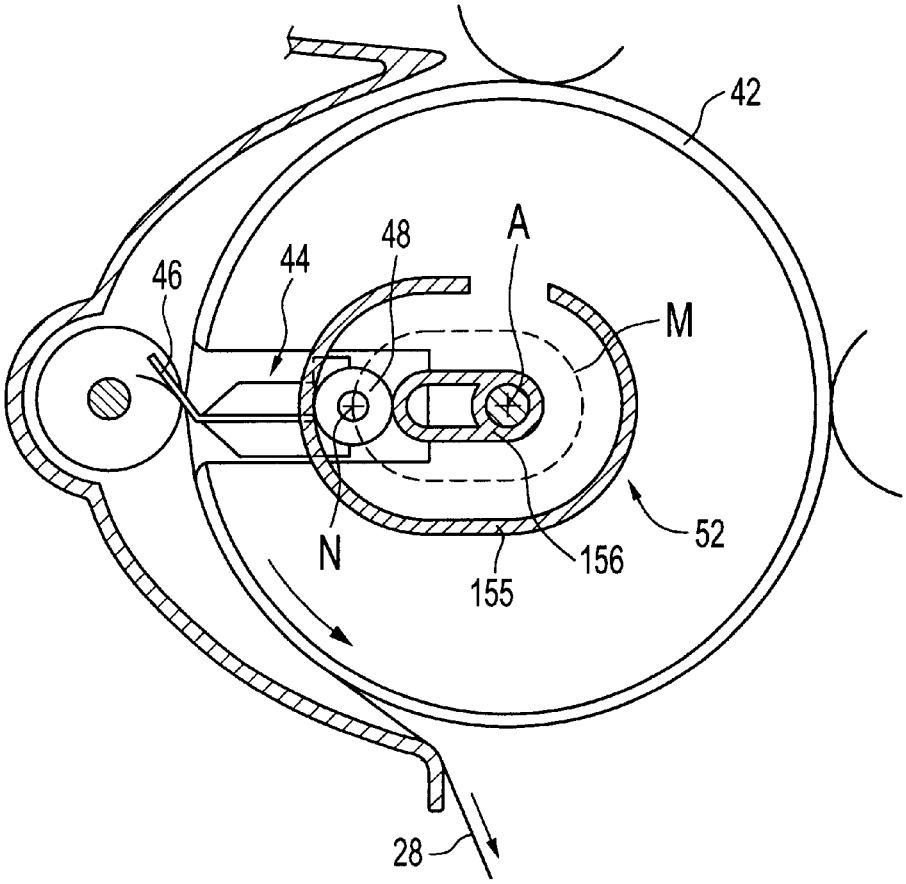
FIG. 14 is a partial cut-away view taken from the same perspective as FIGS. 8 and 11.
Figure 15:
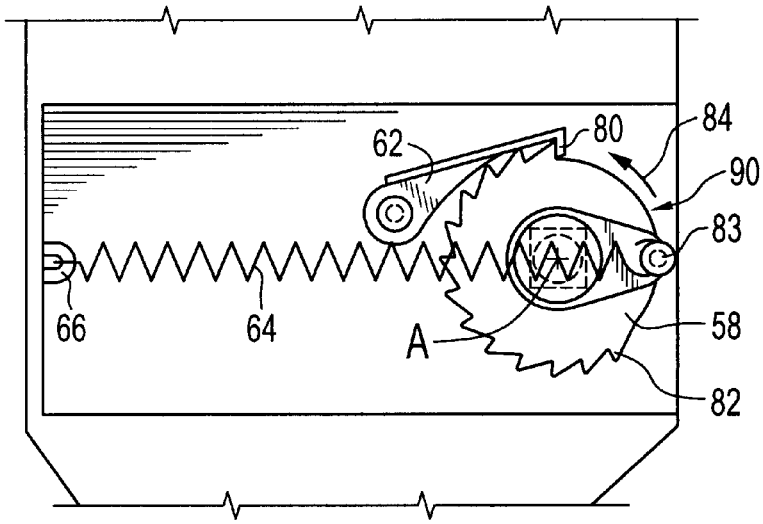
FIG. 15 is a side elevational view taken from the same perspective as FIG. 12.

Referring now to FIGS. 13–15, the dispensing system 20 is shown at the end of its cutting state, with the cutting assembly 44 being fully extended into its cutting position. Comparing FIGS. 10 and 13 shows that the cutting plane H has rotated 180° from the rest position such that the cutting assembly 44 is now directed toward the rear of the system 20. Also, the cutting assembly 44 is now further radially displaced along the cutting plane H by the interaction between the guide members 48*a* and 48*b* and the track members 52 and 54. The blade 46 thus protrudes substantially out of the drum member 42.

Because of the friction between the sheet material 28 and the drum member 42, the angular location of the cutting location 86 relative to the blade 46 does not change while the drum member 42 rotates. The blade 46 thus cuts the sheet material 28 at the cutting location 86 to form a cut end 88 of the predetermined length of sheet material being dispensed.

As show in FIG. 14, the guide member axis N of the guide member 48*a* is now at its maximum distance from the drum axis A. As shown in FIG. 15, the engaging portion 80 of the catch member 62 is now engaging a smooth portion 90 of the ratchet member 58. The flywheel spring 64 is stretched under tension to its longest dimension because the attachment point 83 is now on the opposite side of the drum axis A from the base attachment point 66.

At the end of the cutting state as shown in FIGS. 13–15, the blade 46 has penetrated through the sheet material 28 in a manner that forms perforations in this sheet material 28. Further pulling the sheet material 28 causes a section of this sheet material 28 to be separated from the roll 30 of sheet material 28. The removed section of the sheet material 28 is gripped by the user, so it has been dispensed for use.

From the point the sheet material is separated, the user is no longer applying a downward load on the sheet material 28 that is still connected to the roll 30. But the flywheel spring 64 goes over center and exerts a force on the attachment point 83 that rotates the drum member 42 from the position shown in FIGS. 13 and 14 back into the position shown in FIGS. 4 and 5. And because the tension assembly 34 still maintains friction between the sheet material 28 and the drum member 42, the rotation of the drum member 42 caused by the flywheel spring 64 will continue to feed the undispensed portion of the sheet material 28 such that a new cut end 38 is present at the elongate opening 40.

As the engaging portion 80 of the catch member 62 slides over the smooth portion 90 of the ratchet member 58, it presents little resistance to the rotation of the drum member 42 in either direction. But once the engaging portion 80 travels over the first of the teeth 82, the drum member 42 is again prevented from rotating more than a short distance in the backwards direction. This prevents the drum from oscillating before it finds its steady state in the rest state described above.

From the foregoing, it should be clear that the timing of these various movements is fairly important and the various parts described above should be manufactured and assembled in a manner that consistently and reliably dispenses the sheet material 28. For example, such factors as the tensile strength of the sheet material 28, depth of cut of the blade 46, circumference of the drum member 42, shape of the guide path M, location of the attachment point 83 relative to the cutting assembly 44, and other factors can all affect whether the proper amount of sheet material will be dispensed consistently and reliably.

With the foregoing basic operation of the invention in mind, each of the various assemblies and components described above will now be described in further detail to provide a complete understanding of the operation of the present invention.

Referring initially to the base member 56 of the housing assembly 22, this base member 56 is preferably an injection molded plastic part. The exact details of construction of this part 56 are not critical except as follows.

The base member 56 must provide attachment points for the various assemblies described above. In particular, as shown in FIGS. 3 and 4, the base member 56 further comprises cover attachment points 94, a tension assembly attachment points 96, and first and second rail brackets 98 and 100. The cover attachment points 94 correspond to the cover hinge axis I and allow the cover member 26 to be rotatably attached to the base member 56.

The tension assembly attachment points 96 are aligned with the first tension arm axis C. As will be described in further detail below, the tension assembly 34 is rotatably attached to the base member 56 at these attachment points 96.

This first and second rail brackets 98 and 100 are adapted to engage the roll mounting assembly 36. This will also be described in further detail below.

In addition, the base member 56 defines a curved guide wall 92 that is located immediately behind and surrounds almost half of the drum member 42. The guide wall 92 is smoothly and continuously curved so that it guides the sheet material 28 out of the elongate opening 40 during the process of initially loading the roll 30 and after a section of the sheet material has been perforated and dispensed. In general, the distance between this guide wall 92 and the outer surface of the drum member 42 should be kept at a minimum, with enough space being provided therebetween to allow the sheet material to be fed along the dispensing path G and such that the guide wall 98 does not interfere with or otherwise contact the blade 46 of the cutting assembly 44.

Referring now to FIG. 3, it can be seen that the tension assembly 34 comprises a tension arm 120 and a roller carriage assembly 122. The tension arm 120 comprises first and second side portions 124 and 126. The side portions 124 and 126 are connected to the tension assembly attachment points 96 described above such that the entire tension arm 120 rotates about the first tension arm axis C. The roller carriage assembly 122 is pivotally connected to the side portions 124 and 126 such that the roller carriage assembly 122 rotates about the second tension arm axis D.

The tension roller carriage assembly 122 comprises a carriage member 130 and first and second tension rollers 132 and 134. The tension rollers 132 and 134 are mounted to the carriage member 130 on either side of the second tension arm axis D.

As shown in FIG. 4, the tension assembly 34 further comprises a tension spring 136 connected between an attachment point 138 (FIG. 24) on the tension arm 120 and an attachment point 140 of the base member 56. As shown in FIG. 4, this tension spring 136 opposes rotation of the tension arm 120 away from the drum assembly 32. In other words, the tension spring 136 biases the tension arm 120 toward the drum assembly 32.

In normal use, the tension spring 136 biases the tension arm 120 such that the first and second tension rollers 132 and 134 hold the sheet material 28 against the drum member 42 at front and top locations of the drum member 42. But by grasping the carriage member 130 and pulling upwardly, the tension arm 120 may be rotated against the force of the spring 136 to allow maintenance of the dispensing system 20 and/or insertion of a new roll 30 of sheet material 28 as will be described in further detail below.

The construction of the drum assembly 32 will now be described in further detail. Referring initially to FIG. 7, it can be seen that the drum member 42 may be provided with an external layer 150 to increase the friction between the sheet material 28 and the drum member 42. FIG. 7 also shows that the drum member 42 defines a cutting assembly chamber 152 in which a portion of the cutting assembly 44 resides. The cutting assembly chamber 152 is in communication with the guide channels 72 and 74 as will be described in further detail below.

The drum assembly 32 further comprises a bushing 154 mounted within the guide channel 72 and 74 to reduce friction between the guide pins 68 and 70 and the guide portions 76 and 78 of the drum member 42.

The construction and maintenance of the cutting assembly 44 will now be described in further detail. Referring initially for a moment to FIG. 7, it can be seen therein that nothing on the drum member 42 prevents the cutting assembly 44 from being withdrawn out of the cutting assembly chamber 152. When the drum member 42 is rotated such that the cutting assembly chamber 142 is at the bottom, the cutting assembly 44 is maintained substantially within the cutting assembly chamber 152 by engagement of the guide members 48*a* and 48*b* with the track members 52 and 54.

More specifically, as shown in FIG. 5, the track member 52 comprises an outer flange 155 and an inner flange 156, as shown in FIG. 5. These flanges 155 and 156 define the track 50*a* around which the guide member 48 moves with rotation of the drum member 42.

Figure 17:
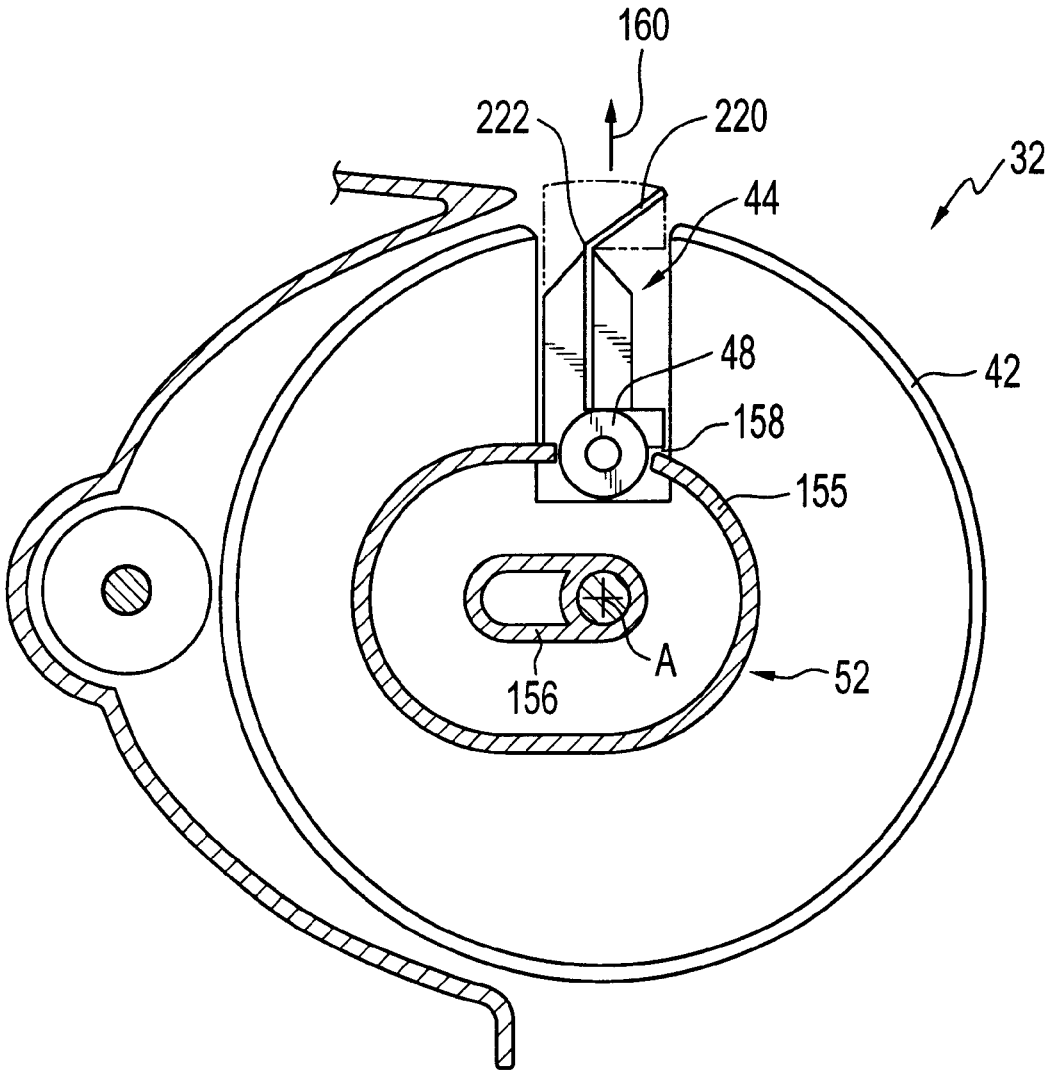
FIG. 17 is a partial cut-away view showing the removal of the cutting assembly from the drum assembly.

To allow the cutting assembly 44 to be removed for service or repair, a gap 158 is formed in the outer flange 155 above the location of the guide member 48 when the dispensing system 20 is in its precut state as shown in FIG. 8. Accordingly, as shown in FIG. 17, the cutting assembly 44 may be removed from the drum assembly 32 by rotating the drum member 42 until the guide member 48 is immediately below the gap 158 and lifting upwardly on the cutting assembly 44 as shown by arrow 160 in FIG. 17. The cutting assembly 44 may thus easily be removed and replaced or repaired without removal of the drum assembly 32. As briefly described above, the tension assembly 34 may be moved out of the way to allow the cutting assembly 44 to be removed as shown in FIG. 17.

Referring now to FIGS. 18–21, the details of construction of the cutting assembly 44 will be described.

The cutting assembly 44 comprises a mounting bracket 162 from which the guide pins 68 and 70 extend, the cutting blade 46, and a retaining member 164. As shown by the exploded view of FIG. 18, the blade 46 is held between the mounting bracket 162 and the retaining member 164. The retaining member 164 mates with the mounting bracket 162 to hold the blade 46 in place.

Figure 19:
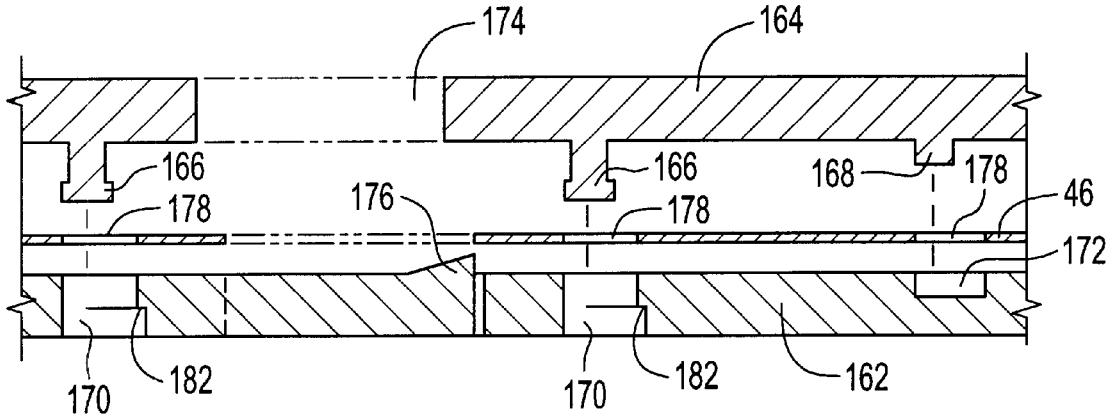
FIGS. 19–21 depict the method of assembling the cutting assembly.
Figure 20:
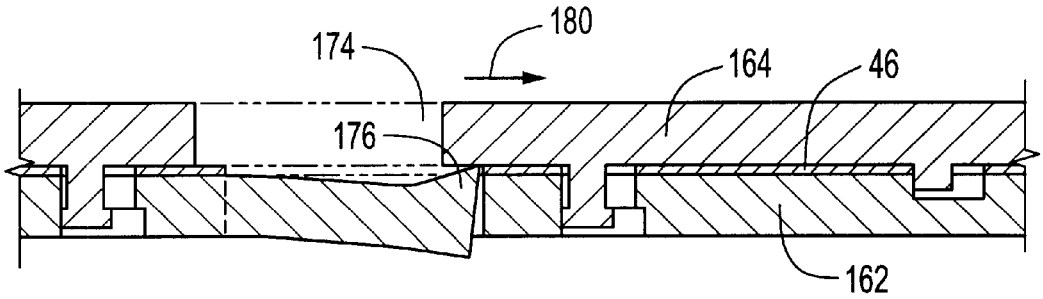
Figure 21:
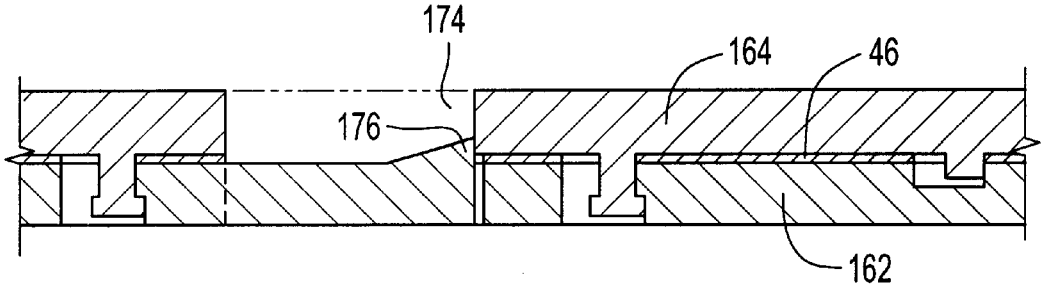

This is perhaps best shown in FIGS. 19–21. These Figures show that a plurality of retaining pins 166 extend from the retaining member 164. Additionally, a plurality of registration pins 168 extend from the retaining member 164. Formed in the mounting bracket 162 are a plurality of retaining holes 170 and retaining cavities 172. Also formed in the retaining member 164 is a detent hole 174 and formed in the retaining member 164 is a detent projection 176. A series of perforations are formed in the blade 46 along with a detent opening 180.

FIGS. 19–21 show that the retaining member 164 is displaced toward the mounting bracket 162 such that the retaining pins 166 and registration pins 168 enter corresponding retaining holes 170 and retaining cavities 172. In so doing, the pins 166 and 168 pass through corresponding perforations 178 in the blade 46. At this point, the retaining member 164 engages the detent projection 176 and distorts the detent projection 176 slightly as shown in FIG. 20.

The retaining member 164 is then slid relative to the mounting bracket 162 in the direction shown by arrow 180 in FIG. 20 into the position shown in FIG. 21. At this point, the detent projection 176 returns to its original position by entering the detent hole 174. The detent projection 176 thus engages the retaining member 164. Additionally, the retaining pins 166 engage shoulders 182 formed in the retaining holes 170 to prevent the retaining member 164 from being removed from the mounting bracket 162.

The blade 46 is thus securely mounted onto the mounting bracket 162 by the retaining member 164. Simply distorting the detent projection 176 such that it no longer engages the retaining member 164 allows this retaining member 164 to be slid in the direction opposite that shown by arrow 180 so that the retaining pins 166 no longer engage the shoulders 182. At this point, the entire assembly may be disassembled into the configuration shown in FIG. 18.

The cutting blade 46 is a stamped and bent sheet of flat steel of sufficient hardness to maintain an edge through continued use. As perhaps best shown in FIG. 16, this blade 46 has a plurality of sheet 220 formed along one edge thereof. These teeth are bent along a line 22 as shown, for example, in FIG. 17. By having the teeth extend at an angle relative to the cutting plane H, the distance that the cutting assembly 44 must move along this plane H to successfully perforate the sheet material 28 is substantially reduced.

Referring now to FIGS. 22–25, the process of removing and replacing the roll 30 of sheet material 28 and of otherwise servicing the dispensing system 20 will be described in further detail.

Figure 24:
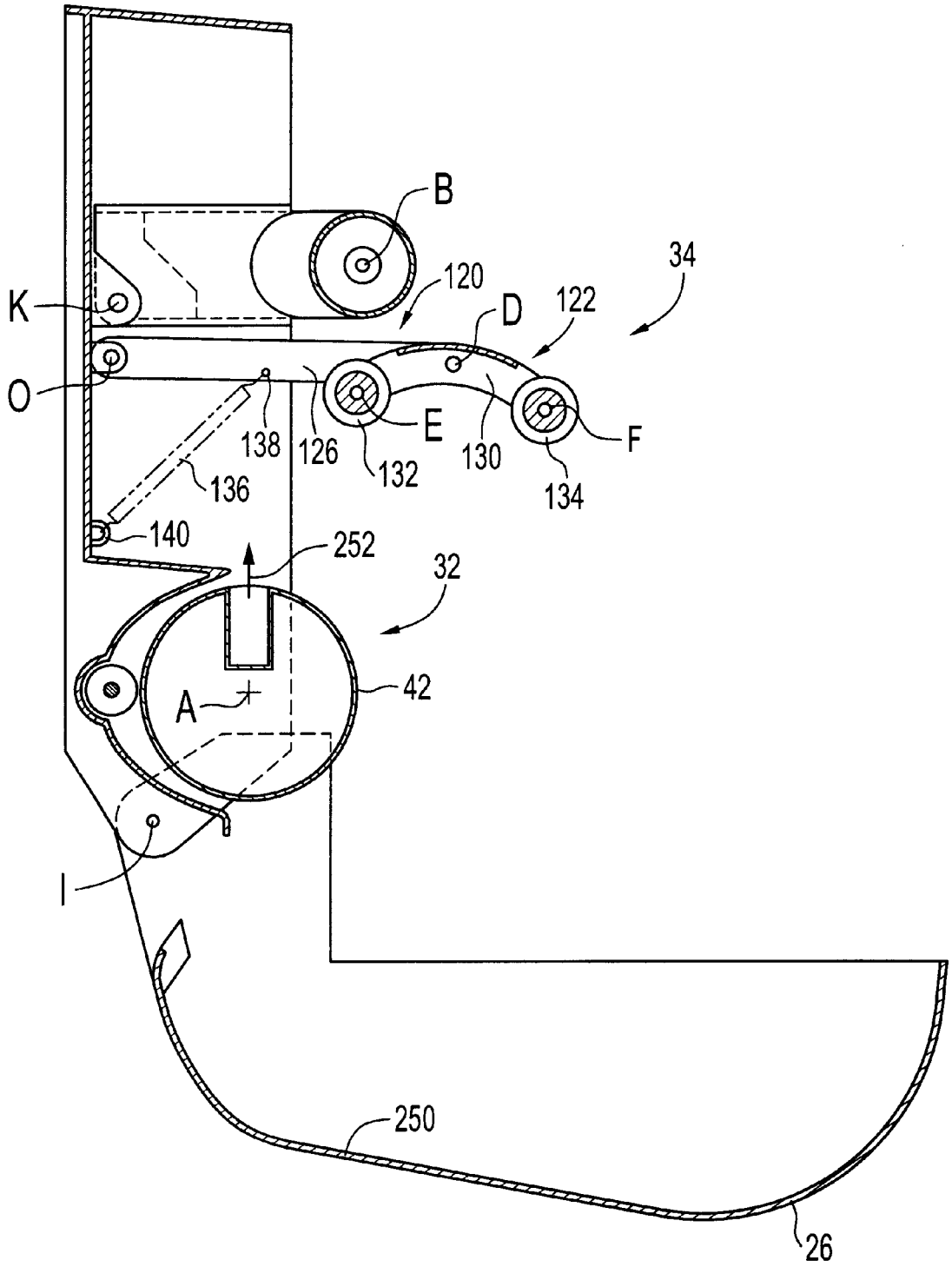
FIGS. 24 and 25 are schematic side cut-away views showing the process of removing the cutting assembly and installing a new roll of sheet material.
Figure 25:
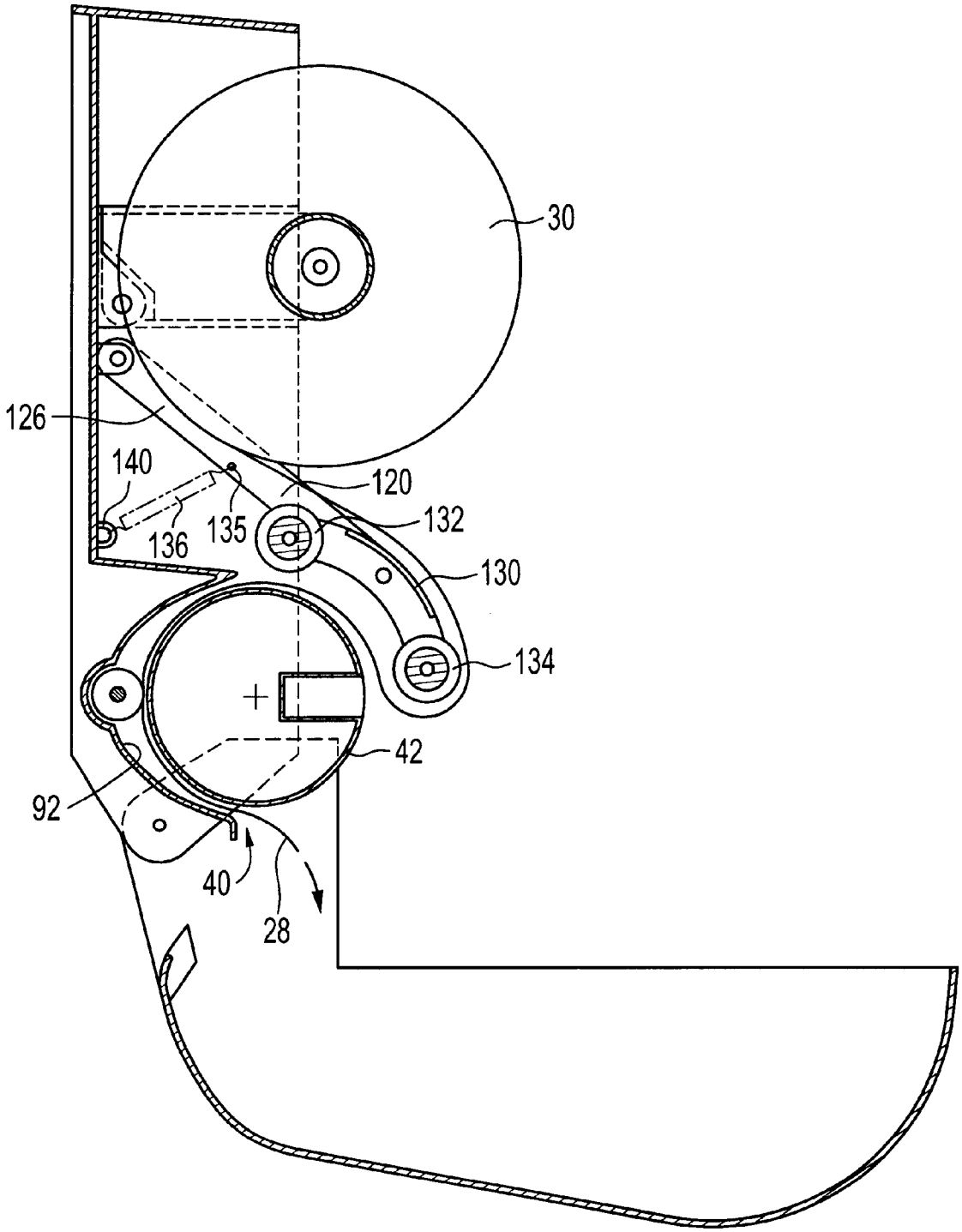

Referring initially to FIG. 24, it can be seen that the cover member 26 may be rotated about the cover hinge axis I into an open position in which an inside surface 250 of the cover 26 may be used as a temporary work surface. FIG. 24 also shows how the tension arm 120 may be rotated to allow the roller carriage assembly 122 to be withdrawn away from the drum assembly 32. With the tension assembly 34 in the position shown in FIG. 24, it can be seen that the cutting assembly 44 may be removed from the drum member 42 along a path 252 for repair and replacement of the blade 46 as described above.

The roll mounting assembly 36 will now be described. This assembly 36 is perhaps best shown in FIGS. 22 and 23.

Figure 22:
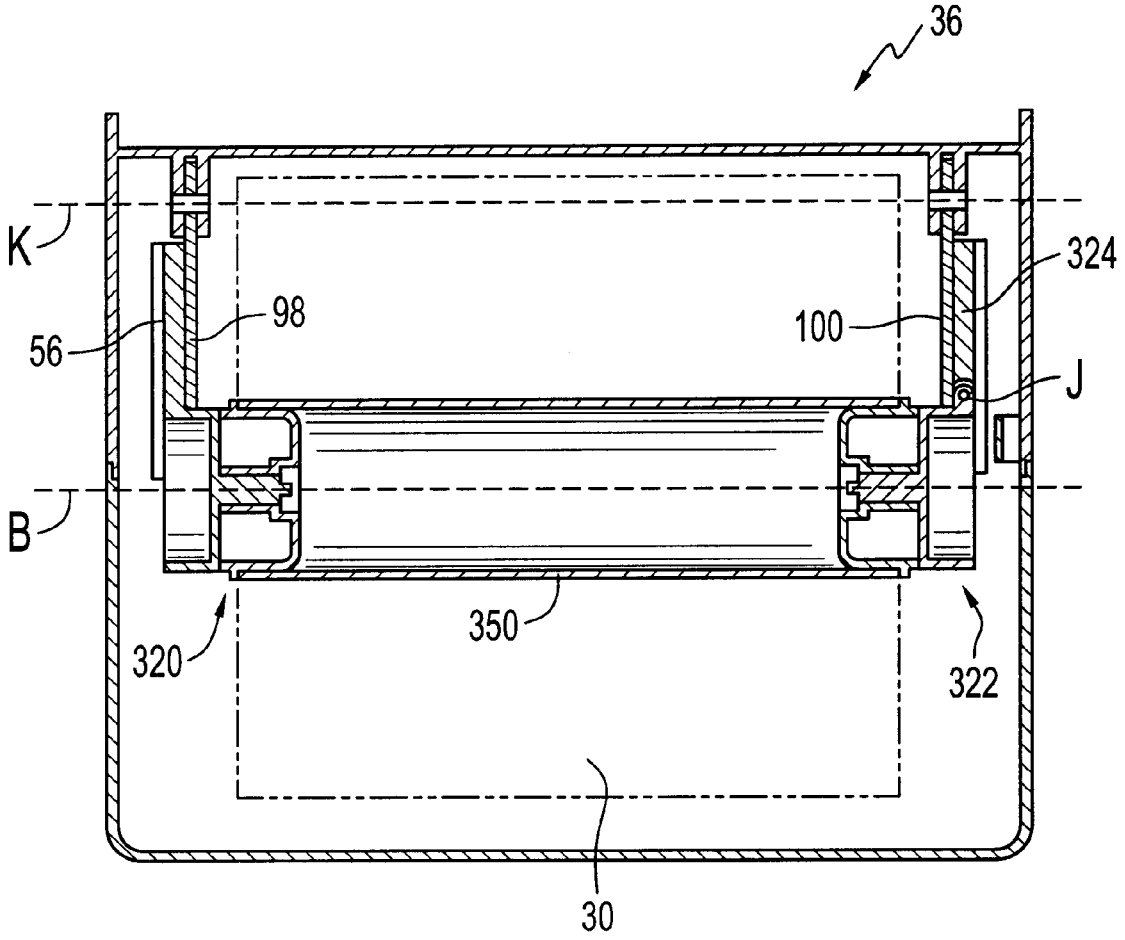
FIG. 22 is a section view taken along lines 22—22 in FIG. 3.
Figure 23:
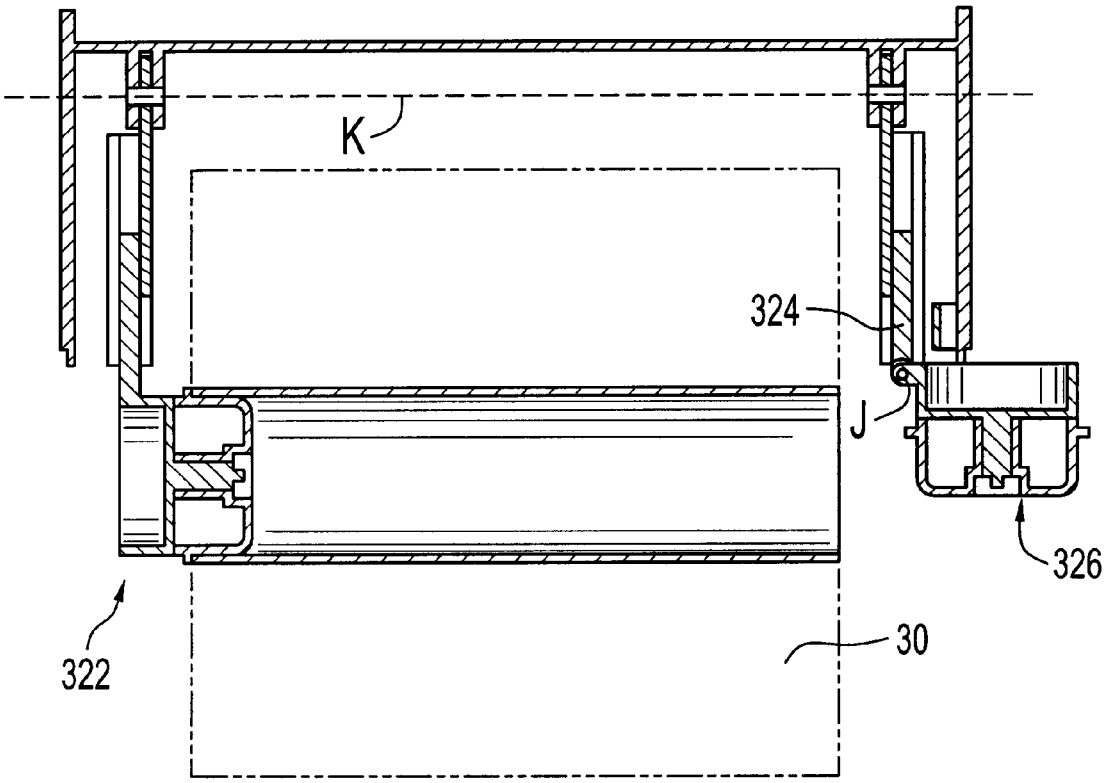
FIG. 23 is a view taken from the perspective similar to that of FIG. 22 showing the process of removing and installing a roll into the system 20.

As shown in FIGS. 22 and 23, the roll mounting assembly 36 comprises a support member 320 and a support assembly 322. The support member 320 is slidably received with the rail portion 98 of the base member 56. The support assembly 322 comprises a rail member 324 and a roll engaging member 326 that is rotatably attached to the rail member 324 at the roll hinge axis J. This rotation is clearly seen by comparison to FIGS. 22 and 23.

The support member 320 engages the hinge portion 100 such that it may slide from front to back (top to bottom in FIGS. 22 and 23) and engages the supports one end of the roll 30. The support assembly 322 also slides front to back, but the roll engaging member 326 thereof also rotates relative to the rail member 324 to allow the roll engaging member 326 to be disengaged from the roll 30. Accordingly, as shown in FIG. 23, the roll may be removed using only one hand.

Additionally, the roll mounting assembly 36 does not require tension to hold the roll and thus does not create friction between the roll mounting assembly 36 and the roll 30.

To install a new roll, the old roll is removed by sliding a core portion 350 thereof away from the base member 56; the support member 320 slides out to accomplish this. The rail engaging member 326 is then rotated such that it is disengaged from the roll core portion 350.

The roll core portion 350 is thus supported at this point by only one end and may easily be removed and discarded. A new roll 30 is placed into the spot where the old roll was removed such that it is supported by the support member 320. The roll engaging member 326 is then rotated back into the position shown in FIG. 22 such that it engages the new roll 30. The whole roll 30 is then slid back to the position shown in FIG. 22. At this point, the roll engaging member 326 engages the base portion 56 to prevent it from rotating into the position shown in FIG. 23. The roll is thus securely held.

At this point, the free end of the sheet material 28 is grasped and pulled down until it extends well below the drum member 42. The free end (the cut end 38) of the sheet material 28 is then passed around the second tension roller 134 and under the first tension roller 132 and fed between the drum member 42 and the curved guide wall 92 until it exits the elongate opening 40. To facilitate the feeding of the sheet material 28 between the drum member 42 and the first and second tension rollers 132 and 134, the tension arm 120 may be rotated upwardly so that these rollers 132 and 134 do not engage the drum member 42.

A number of other enhancements to or features of the basic system described above will now be discussed. These enhancements or features increase the reliability of the dispensing system 20 under most real world situations.

Initially, as shown in the schematic drawing of FIG. 2 and to some extent in FIG. 4, the paper path portion $G_4$ extend between the roll 30 and the first tension roller 132. In addition, the roll mounting assembly 36 is formed such that the tension arm 120 rotates about the roll pivot axis K. The roll pivot axis K is depicted in FIGS. 4 and 22–24. Accordingly, during use the roll 30 rotates downwardly until it rests on the first tension roller 132. Because the roll 30 rests on the first tension roller 132, slack is less likely to develop along the dispensing path G. Such slack may cause jamming of the sheet material 28 within the system 20.

Jamming of the sheet material 28 can also occur when the roll 30 is full. When the roll 30 is full, the sheet material 28 leaves the roll 30 at a location relatively far from the roll axis B. In addition, the roll 30 is heavy when full and develops significant angular momentum as the sheet material 28 is dispensed. These factors can cause the roll 30 to continue to rotate if the sheet material 28 is pulled sharply. If the roll 30 continues to rotate but the drum assembly 32 has stopped rotating, a portion of the sheet material 28 can feed off of the roll 30 and collect behind the tension assembly 34. This can jam the dispensing system 20. This problem is less significant when the roll 30 has been partly used such that it has a smaller diameter and weighs less.

As perhaps best shown in FIG. 3, the dispensing system 20 comprises a brake member 420 that slows the rotation of the roll 30 when the roll 30 is full. In particular, the brake member 420 extends upwardly and inwardly from the base member 24 such that, when the roll 30 is full, the brake member 420 frictionally engages the roll engaging member 326 that supports one end of the roll 30. As the roll 30 becomes used, its diameter decreases and the roll axis B drops because the roll 30 is supported by the hinged tension arm 120 and rests on the first tension roller 132. As the roll axis B drops, the brake member 420 contacts the roll engaging member 326 with less and less force until at some point the roll engaging member 326 is no longer in contact with the brake member 420. The brake member 420 thus prevents the roll 30 from freely rotating when full or nearly full but does not interfere with rotation of the roll when it becomes nearly empty.

Figure 13A:
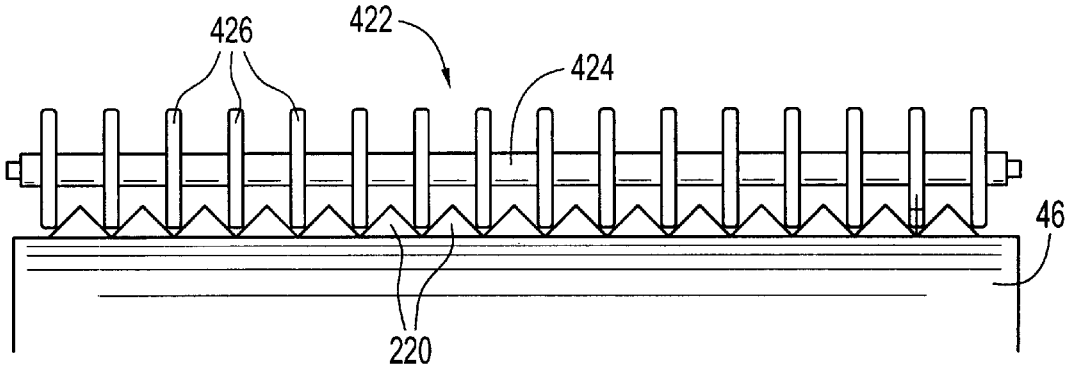
FIG. 13A is a partial top plan view illustrating the physical relationship between the cutting blade and wheel roller when the cutting blade in its cutting position.

Referring now to FIGS. 13 and 13A, depicted therein is a wheel roller 422 that holds the sheet material 28 against the drum 42 at the cutting location 86. As is best shown in FIG. 13A, the wheel roller 422 comprises a relatively narrow shaft 424 and a plurality of wheels 426. The shaft 426 defines the wheel roller axis L and is fixed relative to the drum axis A. The wheels 426 are spaced at predetermined locations along the length of the shaft 424. The wheels 426 have a radius that is substantially the same as the distance between the roller axis L and a surface 428 of the drum member 42.

For most of the rotation of the drum member 42, the wheels 426 simply engage the sheet material 28 and hold the sheet material against the drum surface 428. When the drum 42 rotates such that the cutting blade 46 begins to cut the sheet material 28, the wheels 426 engage and support the sheet material 28 as it is being cut. Without the wheels 426, some grades of sheet material stretch rather than puncture when engaged by the cutting blade 46.

As is apparent from FIG. 13A, the wheels 426 are arranged such that the teeth 220 of the blade 446 extend between the wheels 426. The wheels 426 thus do not interfere with the movement of the blade 446 described above.

Referring for a moment back to FIG. 3, depicted there is another feature of the present invention designed to increase the reliability thereof. In particular, the system 20 relies on the frictional engagement between the drum member 42 and the sheet material 28 to feed the cut end 38 so that the cut end 38 may be grasped by the next user. This frictional engagement can result in the cut end 38 being carried back into the enclosure assembly 22. The next user thus cannot easily grip the sheet material 28 as required to operate the system 20.

To prevent this problem, a plurality of grooves 430 are formed in the surface 428 of the drum member 42 as is shown in FIG. 3. And as shown in FIG. 4, peeling projections 432 are formed on the cover member 26 such that, when the cover member 26 is closed, the peeling projections 432 extend into the grooves 430 at a location adjacent to the elongate opening 40. Accordingly, as the cut end 38 is fed toward the elongate opening 40, the peeling projections 432 peel this cut end 38 off of the drum surface 428 and direct the cut end 38 out of the elongate opening 40. The drum grooves 430 and peeling projections 432 thus ensure that the cut end 38 does not adhere to the drum member 42 and becomes fed back into the enclosure assembly 22.

From the foregoing, it should be apparent that the present invention may be embodied in forms other than that discussed above. The scope of the present invention should thus be determined by reference to the following claims and not the foregoing detailed description.

I claim:

1. A system for dispensing paper towels from a continuous roll of paper towel material, comprising:

an enclosure assembly defining an enclosure chamber and an outlet opening and having a door member for allowing selective access to said enclosure chamber;

a roll support assembly for supporting said roll within said enclosure chamber such that an end of said paper towel material extends through said outlet opening;

a drum member having a cylindrical surface, said drum member mounted to said enclosure assembly such that said drum member is rotatable relative to said enclosure assembly about a drum axis, said drum member positioned so that said paper towel material passes over said drum member and, when said paper towel material is pulled by a user, said paper towel material frictionally engages said drum member and causes said drum member to rotated about said drum axis, said drum member having an elongated slot along a length of said cylindrical surface;

a cutting assembly slidably mounted in said elongated slot and movable in response to rotation of said drum member from a retracted position in which said cutting assembly is entirely within said drum member to a cutting position in which said cutting assembly at least partially extends from said elongated slot and cuts said paper towel material and wherein said cutting assembly is slidably removable from said drum member at a predetermined angular position of said drum member relative to said enclosure assembly; and tensioning means for holding said paper towel material against said drum member.

2. A system as recited in claim 1, in which the rotation of said cutting assembly is controlled by a guide projection engaging a track defined by an inner flange and an outer flange mounted on said enclosure assembly.

3. A system as recited in claim 2, in which a notch is formed in said outer flange to allow said cutting assembly to be one of removed from and placed into said drum member.

4. A system as recited in claim 1, in which said cutting assembly comprises a cutting blade attached to a mounting bracket, where guide pins extend from said mounting bracket to guide said cutting assembly between said retracted position and said cutting position.

5. A system as recited in claim 1, in which said cutting assembly comprises a cutting blade arranged to move along a cutting plane defined by said drum member, where said cutting blade comprises a plurality of teeth angled with respect to said cutting plane.

6. A system as recited in claim 1, in which at least one drum groove is formed in said cylindrical surface of said drum member, said system further comprising a peeling projection formed on said enclosure assembly such that said peeling projection extends into said at least one drum groove and forces a cut end of said sheet material out of said outlet opening.

7. A system as recited in claim 1, wherein said tensioning means includes at least one tensioning wheel arranged between said roll and said drum member such that said roll is in contact with said at least one tensioning wheel and said at least one tensioning wheel is contact with said drum member.

8. A system as recited in claim 1, further comprising a brake member arranged on said enclosure assembly such that said brake member resists rotation of said roll when said roll is full and does not resist rotation of said roll when said roll is empty.

9. A system as recited in claim 1, wherein said tensioning means includes a tensioning arm, a roller journalled to said tensioning arm, and a biasing means for biasing said roller against drum member.

10. A system for dispensing paper towels from a continuous roll of paper towel material comprising:

an enclosure assembly defining an enclosure chamber and an outlet opening and having a door member for allowing selective access to said enclosure chamber;

a roll support assembly for supporting said roll within said enclosure chamber such that an end of said paper towel material extends through said outlet opening;

a drum member having a cylindrical surface, said drum member mounted to said enclosure assembly such that said drum member is rotatable relative to said enclosure assembly about a drum axis, said drum member positioned so that said paper towel material passes over said drum member and, when said paper towel material is pulled by a user, said paper towel material frictionally engages said drum member and causes said drum member to rotate about said drum axis, said drum member having an elongated slot along a length of said cylindrical surface;

tensioning means for holding said sheet material against said drum member, wherein said tensioning means includes at least one tensioning wheel arranged between said roll and said drum member such that said roll is in contact with said at least one tensioning wheel and said at least one tensioning wheel is contact with said drum; and a cutting assembly attached to said drum member such that said cutting assembly is capable of moving between a retracted position in which said cutting assembly is entirely within said drum member and a cutting position in which said cutting assembly at least partly extends out of said drum member.

11. A system as recited in claim 10, in which movement of said cutting assembly between said retracted position and said cutting position is in response to said rotation of said drum member and said movement is controlled by a guide projection engaging a track defined by an inner flange and an outer flange mounted on said enclosure assembly.

* * * * *

UNITED STATES PATENT AND TRADEMARK OFFICE

CERTIFICATE OF CORRECTION

PATENT NO. : 6,581,500 B1
DATED : June 24, 2003
INVENTOR(S) : Josef Kietaibl

It is certified that error appears in the above-identified patent and that said Letters Patent is hereby corrected as shown below:

Column 1,
Line 57, "dispenser" should read -- dispensers --.

Column 4,
Line 34, "simply" should read -- simple --.

Column 5,
Line 37, after "between" insert -- the --.

Column 6,
Line 14, delete the period (".") after "axis".
Line 15, "on" should read -- one --.
Lines 39 and 55, "toward" should read -- towards --.
Line 60, "of" should read -- or --.

Column 7,
Line 13, "toward" should read -- towards --.
Line 26, "show" should read -- shown --.

Column 8,
Line 65, "of' should read -- on --.

Column 9,
Line 33, "142" should read -- 152 --.

Column 10,
Line 9, "toward" should read -- towards --.
Line 37, "sheet" should read -- teeth --.
Line 38, "22" should read -- 222 --.

Column 11,
Line 3, "engages the supports" should read -- engages and supports --.
Line 47, "extend" should read -- extends --.

Column 12,
Line 45, "there" should read -- therein --.
Line 62, "toward" should read -- towards --.
Line 67, "becomes" should read -- become --.

UNITED STATES PATENT AND TRADEMARK OFFICE

CERTIFICATE OF CORRECTION

PATENT NO. : 6,581,500 B1
DATED : June 24, 2003
INVENTOR(S) : Josef Kietaibl

It is certified that error appears in the above-identified patent and that said Letters Patent is hereby corrected as shown below:

Column 13,
Line 23, "rotated" should read -- rotate --.

Column 14,
Line 8, after "is" insert -- in --.
Line 18, after "against" insert -- said --.
Line 20, after "material" insert a comma (-- , --)
Line 44, after "is" insert -- in --.

Signed and Sealed this

Fourth Day of November, 2003

JAMES E. ROGAN
*Director of the United States Patent and Trademark Office*